US011393397B2

(12) United States Patent
Xuan et al.

(10) Patent No.: US 11,393,397 B2
(45) Date of Patent: Jul. 19, 2022

(54) PIXEL DRIVING CIRCUIT, PIXEL UNIT AND DRIVING METHOD, ARRAY SUBSTRATE, AND DISPLAY DEVICE

(71) Applicant: BOE TECHNOLOGY GROUP CO., LTD., Beijing (CN)

(72) Inventors: Minghua Xuan, Beijing (CN); Han Yue, Beijing (CN); Ning Cong, Beijing (CN); Xiaochuan Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/639,066

(22) PCT Filed: Sep. 12, 2019

(86) PCT No.: PCT/CN2019/105759
§ 371 (c)(1),
(2) Date: Feb. 13, 2020

(87) PCT Pub. No.: WO2020/151233
PCT Pub. Date: Jul. 30, 2020

(65) Prior Publication Data

US 2021/0366396 A1 Nov. 25, 2021

(30) Foreign Application Priority Data

Jan. 22, 2019 (CN) ..... 201910059510.9

(51) Int. Cl.
*G09G 3/3258* (2016.01)
*G09G 3/325* (2016.01)
(Continued)

(52) U.S. Cl.
CPC ..... *G09G 3/3258* (2013.01); *G09G 3/325* (2013.01); *G09G 3/3618* (2013.01);
(Continued)

(58) Field of Classification Search
CPC .... G09G 3/3233; G09G 3/3258; G09G 3/325; G09G 3/3618; G09G 2320/0233;
(Continued)

(56) References Cited

U.S. PATENT DOCUMENTS 9,230,481 B2 * 1/2016 Tseng ..... G09G 3/3258
2014/0084932 A1 3/2014 Chaji et al.
(Continued)

FOREIGN PATENT DOCUMENTS

CN 102982766 A 3/2013
CN 105913801 A 8/2016
(Continued)

OTHER PUBLICATIONS

State Intellectual Property Office of the People's Republic of China, Office Action and Search Report Issued in Application No. 201910059510.9, dated Dec. 25, 2019, 32 pages. (Submitted with Partial Translation).
(Continued)

*Primary Examiner* — Tom V Sheng
(74) *Attorney, Agent, or Firm* — McCoy Russell LLP

(57) ABSTRACT

A pixel driving circuit, a pixel unit and a driving method therefor, an array substrate, and a display device for reducing mura phenomenon comprise: a data write sub-circuit for transmitting signals input by the data voltage terminal to a first node; an input and read sub-circuit for transmitting a signal input from a signal transmission terminal to a second node, or reading an electric signal of the second node to the signal transmission terminal; and an output control sub-circuit for transmitting a signal of a first voltage terminal to a drive sub-circuit, and transmitting a driving signal output by the drive sub-circuit to a driven circuit, wherein the drive
(Continued)

sub-circuit outputs the driving signal under control of the signal of the first node and the signal of the first voltage terminal.

20 Claims, 16 Drawing Sheets

(51) Int. Cl.
*G09G 3/36* (2006.01)
*G09G 3/3233* (2016.01)

(52) U.S. Cl.
CPC ..... *G09G 3/3233* (2013.01); *G09G 2300/043* (2013.01); *G09G 2300/0819* (2013.01); *G09G 2300/0842* (2013.01); *G09G 2320/0233* (2013.01)

(58) Field of Classification Search
CPC ..... G09G 2300/043; G09G 2300/0842; G09G 2300/0819
USPC ..... 345/204
See application file for complete search history.

(56) References Cited

U.S. PATENT DOCUMENTS

2014/0252988 A1* 9/2014 Azizi ..... G09G 3/3233 315/307
2014/0267215 A1* 9/2014 Soni ..... G09G 3/3291 345/82
2015/0294626 A1* 10/2015 Bi ..... G09G 3/3233 345/82
2016/0063921 A1* 3/2016 Tsai ..... G09G 3/3233 345/76
2016/0155377 A1* 6/2016 Kishi ..... G09G 3/3233 345/214
2017/0025063 A1* 1/2017 Chaji ..... G09G 3/3233
2017/0103703 A1 4/2017 Bi et al.
2017/0287398 A1* 10/2017 Soni ..... G09G 3/3291
2017/0358251 A1* 12/2017 Chaji ..... G09G 3/3291
2019/0272785 A1* 9/2019 Qian ..... G09G 3/3233
2020/0043417 A1* 2/2020 Yang ..... G09G 3/3266

FOREIGN PATENT DOCUMENTS

CN 106297666 A 1/2017
CN 107993614 A 5/2018
CN 108417169 A 8/2018
CN 108766349 A 11/2018
CN 109166528 A 1/2019
CN 109215569 A 1/2019
CN 109584788 A 4/2019

OTHER PUBLICATIONS

State Intellectual Property Office of the People's Republic of China, Supplemental Search Issued in Application No. 201910059510.9, dated Jun. 30, 2020, 1 page.
State Intellectual Property Office of the People's Republic of China, Office Action and Search Report Issued in Application No. 201910059510 9, dated Jul. 7, 2020, 33 pages (Submitted with Partial Translation).
ISA National Intellectual Property Administration, International Search Report and Written Opinion Issued in Application No. PCT/CN2019/105759, dated Dec. 12, 2019, WIPO, 9 pages.

* cited by examiner

PIXEL DRIVING CIRCUIT, PIXEL UNIT AND DRIVING METHOD, ARRAY SUBSTRATE, AND DISPLAY DEVICE

CROSS-REFERENCE TO RELATED APPLICATIONS

The present application is a U.S. National Phase of International Patent Application Serial No. PCT/CN2019/105759 entitled "PIXEL DRIVING CIRCUIT, PIXEL UNIT AND DRIVING METHOD, ARRAY SUBSTRATE, AND DISPLAY DEVICE," filed on Sep. 12, 2019. International Patent Application Serial No. PCT/CN2019/105759 claims priority to Chinese Patent Application No. 201910059510.9 filed on Jan. 22, 2019. The entire contents of each of the above-listed applications are hereby incorporated by reference for all purposes.

TECHNICAL FIELD

The present disclosure relates to the field of display technologies, and in particular, to a pixel driving circuit, a pixel unit and a driving method, an array substrate, and a display device.

BACKGROUND

μLED (micro light-emitting diode) technology realizes thinning, miniaturization and matrixing of LEDs by high-density integration of tiny-sized LED arrays on one chip, wherein the distance between pixels can reach the micron level, and each pixel can be addressed and illuminated separately. Due to their low driving voltage, long life, and wide temperature resistance, μLED display panels have gradually developed into display panels for consumer terminals.

Taking the pixel driving circuit for driving a light-emitting circuit as an example, in related art, the LED in a μLED device is transferred onto a silicon-based substrate by transfer technology, and the IC (integrated circuit) supplies a voltage signal to activate the LED; however, due to a process error in each LED, the difference in the starting voltage is large. Consequently, the voltage starting mode directly driven by the IC will cause uneven brightness across the μLED device due to the different starting voltage of the LED, resulting in mura (moiré) phenomenon.

SUMMARY

Embodiments of the present disclosure provide a pixel driving circuit, a pixel unit and a driving method, an array substrate, and a display device for reducing uneven brightness caused by the mura phenomenon resulting from a manner in which a starting voltage is driven.

In order to achieve the above object, embodiments of the present disclosure adopt the following technical solutions:

In a first aspect, a pixel driving circuit is provided, including a data write sub-circuit, an input and read sub-circuit, a drive sub-circuit, and an output control sub-circuit; the data write sub-circuit is connected to a first node and a scan signal terminal, and a data voltage terminal, and is configured to transmit, under control of the scan signal terminal, signals input by the data voltage terminal at different times to the first node; the input and read sub-circuit is connected to a second node, a first signal terminal, and a signal transmission terminal, and is configured to transmit, by the first signal terminal, a signal input by the signal transmission terminal to the second node, and to read and transmit an electrical signal of the second node to the signal transmission terminal; the output control sub-circuit is respectively connected to a drive sub-circuit, a driven circuit, an enable signal terminal, and a first voltage terminal, for transmitting a signal of the first voltage terminal, under control of an enable signal terminal, to the drive sub-circuit; the drive sub-circuit is further connected to the first node and the second node, for outputting the driving signal under control of a signal of the first node and the signal of the first voltage terminal.

In the preceding example system, additionally or optionally, the data write sub-circuit includes a first transistor, wherein a gate of the first transistor is connected to the scan signal terminal, and a first pole of the first transistor is connected to the data voltage terminal, and a second pole of a transistor is coupled to the first node.

In any or all of the preceding example systems, additionally or optionally, the input and read sub-circuit includes a second transistor, wherein a gate of the second transistor is connected to the first signal terminal, and a first pole of the second transistor is connected to the signal transmission terminal, and a second pole of the second transistor is coupled to the second node.

In any or all of the preceding example systems, additionally or optionally, the drive sub-circuit includes a storage capacitor and a drive transistor, wherein a first terminal of the storage capacitor is connected to the first node, a second terminal of the storage capacitor is connected to the second node, a gate of the drive transistor is connected to the first node, a first pole of the drive transistor is connected to the output control sub-circuit, and a second pole of the drive transistor is connected to the second node and the output control sub-circuit.

In any or all of the preceding example systems, additionally or optionally, the output control sub-circuit includes a third transistor and a fourth transistor, wherein a gate of the third transistor is connected to the enable signal terminal, a first pole of the third transistor is connected to the driven circuit, a second pole of the third transistor is connected to the drive sub-circuit, a gate of the fourth transistor is connected to the enable signal terminal, a first pole of the fourth transistor is connected to the first voltage terminal, and a second pole of the fourth transistor is coupled to the drive sub-circuit.

The second aspect provides a pixel unit, comprising the pixel driving circuit and the light-emitting circuit according to any one of the first aspect, wherein the light-emitting circuit is connected to an output control sub-circuit of the pixel driving circuit and a second voltage terminal for emitting light when driven by the driving signal output from the pixel driving circuit and the signal of the second voltage terminal.

In the preceding example system, additionally or optionally, the light-emitting circuit comprises a self-luminous device, wherein an anode of the self-luminous device is connected to the second voltage terminal, and a cathode of the self-luminous device is connected to a first pole of a third transistor of the output control sub-circuit, and a signal output by the second voltage terminal is higher than a signal output by the first voltage terminal of the pixel driving circuit.

In any or all of the preceding example systems, additionally or optionally, the light-emitting circuit comprises a self-luminous device, wherein an anode of the self-luminous device is connected to a first pole of a third transistor in the output control sub-circuit, and a cathode of the self-luminous device is connected to the second voltage terminal, and the signal output by the second voltage terminal is lower than a signal output by the first voltage terminal of the pixel driving circuit.

In a third aspect, an array substrate is provided, comprising the plurality of pixel units of the first aspect.

In the preceding example system, additionally or optionally, the array substrate further includes a plurality of transmission circuits, each of the pixel units is correspondingly connected to one of the transmission circuits, and each of the transmission circuits is connected to a signal transmission terminal, and the transmission circuit is configured to input a signal to the signal transmission terminal connected to the transmission circuit, and to read the electrical signal of the second node output by the signal transmission terminal.

In any or all of the preceding example systems, additionally or optionally, the array substrate further includes a data line connecting data voltage terminals, wherein a column of the pixel units is connected to the same data line and to the same transmission circuit.

In any or all of the preceding example systems, additionally or optionally, the transmission circuit includes a fifth transistor, wherein a gate of the fifth transistor is connected to the second signal terminal, and a first pole of the fifth transistor is connected to the signal transmission terminal, and a second pole of the fifth transistor is connected to the read signal line, wherein the read signal line is configured for transmitting a signal input to the signal transmission terminal, or for transmitting an electrical signal of the second node output by the signal transmission terminal.

In any or all of the preceding example systems, additionally or optionally, the transmission circuit includes a sixth transistor and a seventh transistor, wherein a gate of the sixth transistor is connected to a third signal terminal, a first pole of the sixth transistor is connected to the signal transmission terminal, a second pole of the sixth transistor is connected to the third voltage terminal, a gate of the seventh transistor is connected to the fourth signal terminal, a first pole of the seventh transistor is connected to the signal transmission terminal, and a second pole of the seventh transistor is connected to the read signal line.

According to a fourth aspect, a display device comprises the array substrate of the third aspect, and further comprises an integrated circuit connected to the signal transmission terminal, wherein the integrated circuit is configured to receive the electrical signal of the second node output by the signal transmission terminal to obtain a threshold voltage of the drive sub-circuit and generate a compensated data signal.

In the preceding example system, additionally or optionally, the array substrate includes a transmission circuit, the integrated circuit is connected to the read signal line, and the electrical signal of the second node output by the signal transmission terminal is transmitted to the integrated circuit by way of the read signal line.

A fifth aspect provides a method of driving a pixel unit, wherein the pixel unit includes a pixel driving circuit and a light-emitting circuit, and wherein the pixel driving circuit includes a data write sub-circuit, an input and a read sub-circuit, a drive sub-circuit, and an output control a sub-circuit. Data is written into the data write sub-circuit connected to a first node, a scan signal terminal and a data voltage terminal; the input and read sub-circuit is connected to the second node, the first signal terminal and the signal transmission terminal; the drive sub-circuit is connected to the first node and the second node; the output control sub-circuit is respectively connected to the drive sub-circuit, the light-emitting circuit, the enable signal terminal and the first voltage terminal; and the light-emitting circuit is connected to the output control sub-circuit of the pixel driving circuit and a second voltage terminal. The method of driving the pixel unit includes: a first stage, including the data write sub-circuit transmitting a first initialization signal input by the data voltage terminal, under control of the scan signal terminal, to the first node, and the input and read sub-circuit transmitting a second initialization signal input of the signal transmission terminal, under control of the first signal terminal, to the second node; a second stage, including the data write sub-circuit transmitting a first data signal input by the data voltage terminal, under control of the scan signal terminal, to the first node, and the input and read sub-circuit transmitting the electrical signal of the second node to the signal transmission terminal under control of the first signal terminal; a third stage, including the data write sub-circuit transmitting a second data signal input by the data voltage terminal to the first node under control of the scan signal terminal, and storing the second data signal to the drive sub-circuit, wherein the second data signal includes a signal obtained by compensating the first data signal, and the input and read sub-circuit transmitting a potential signal input by the signal transmission terminal to the second node under control of the first signal terminal; a fourth stage, including the output control sub-circuit transmitting a signal of the first voltage terminal to the drive sub-circuit under control of an enable signal terminal, the drive sub-circuit outputting a driving signal under control of a signal of the first node and a signal of the first voltage terminal, the output control sub-circuit transmitting the driving signal to the light-emitting circuit under control of the enable signal terminal, and the light-emitting circuit emitting light when driven by the driving signal and the second voltage terminal.

In the preceding example system, additionally or optionally, the data write sub-circuit includes a first transistor, the input and read sub-circuit includes a second transistor, the drive sub-circuit includes a drive transistor and a storage capacitor, and the output control sub-circuit includes a third transistor and a fourth transistor. The method optionally includes: the first stage, including the first transistor transmitting the first initialization signal output by the data voltage terminal to the first node under control of the scan signal terminal, and the second transistor transmitting the second initialization signal received by the signal transmission terminal to the second node under control of the first signal terminal; the second stage, including the first transistor transmitting the first data signal output by the data voltage terminal to the first node under control of the scan signal terminal, and the second transistor transmitting an electrical signal of the second node is transmitted to the signal transmission terminal under control of the first signal terminal; a third stage, including the first transistor transmitting the second data signal output by the data voltage terminal to the first node under control of the scan signal terminal, and storing the second data signal to the storage capacitor, and the second transistor transmitting the potential signal received by the signal transmission terminal to the second node under control of the first signal terminal; and the fourth stage, including the storage capacitor transmitting the second data signal stored therein to a gate of the drive transistor to control turning on the drive transistor, the fourth transistor transmitting a signal of the first voltage terminal to the drive transistor under control of the enable signal terminal, wherein the drive transistor outputs the driving signal under control of the second data signal and the signal of the first voltage terminal, the third transistor transmitting the driving signal to the light-emitting circuit under control of the enable signal, and the light-emitting circuit emitting light when driven by the driving signal and the signal of the second voltage terminal.

Embodiments of the present disclosure provide a pixel driving circuit, a pixel unit and a method of driving a pixel unit, an array substrate, and a display device. The driven circuit is driven by a drive current generated by a drive sub-circuit, and a threshold voltage generated by the drive sub-circuit is compensated before the drive current is generated.

When the pixel driving circuit provided by the present disclosure is applied to a μLED display panel, each LED is driven by a drive current provided by the pixel driving circuit, which is a stable drive current supplied by the drive sub-circuit. Since the starting current of each LED is the same, the stable drive current can increase performance of the μLED display panel by reducing occurrence of the mura phenomenon caused by a large differences in the LED lighting drive voltage (<1 V), such as is observed in the related art.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the summary above does not constitute an admission that the technical problems and challenges discussed were known to anyone other than the inventors.

BRIEF DESCRIPTION OF THE DRAWINGS

The drawings in the following description are only some embodiments of the present disclosure. Reasonable variations of these figures are also encompassed within the scope of the present disclosure.

DETAILED DESCRIPTION

The following description relates to a pixel driving circuit, a pixel unit and a method of driving a pixel unit, an array substrate, and a display device. The embodiments of the present disclosure will be further described in detail below with reference to the accompanying figures. It is apparent that the described embodiments are part of the embodiments of the present disclosure, and not all of the embodiments. All other embodiments obtained by a person of ordinary skill in the art based on the described embodiments of the present disclosure without departing from the scope of the invention are within the scope of the disclosure. Unless otherwise defined, technical terms or scientific terms used in the present disclosure are intended to be understood in the ordinary meaning of the ordinary skill of the art. The words "first", "second," and similar terms used in the present disclosure do not denote any order, quantity, or importance, but are used to distinguish different components. "Comprising" or similar terms means that the elements or objects that appear before the word include the elements or items that appear after the word and their equivalents, and do not exclude other elements or items. The words "connected" and the like are not limited to physical or mechanical connections, but may include electrical connections, and the connections may be direct or indirect.

In related art for μLED display devices, during the display process, the LEDs have different starting voltages, when the same voltage is input, some of the LEDs are already lit, some are not bright, or some are very bright, and some are not very bright due to differences in the starting voltages of the LEDs. Consequently, the method of using voltage to control the brightness of the LEDs may cause a problem whereby the brightness of each LED cannot be accurately controlled due to differences in the starting voltage of each LED, resulting in the emergence of a mura phenomenon.

Figure 1:
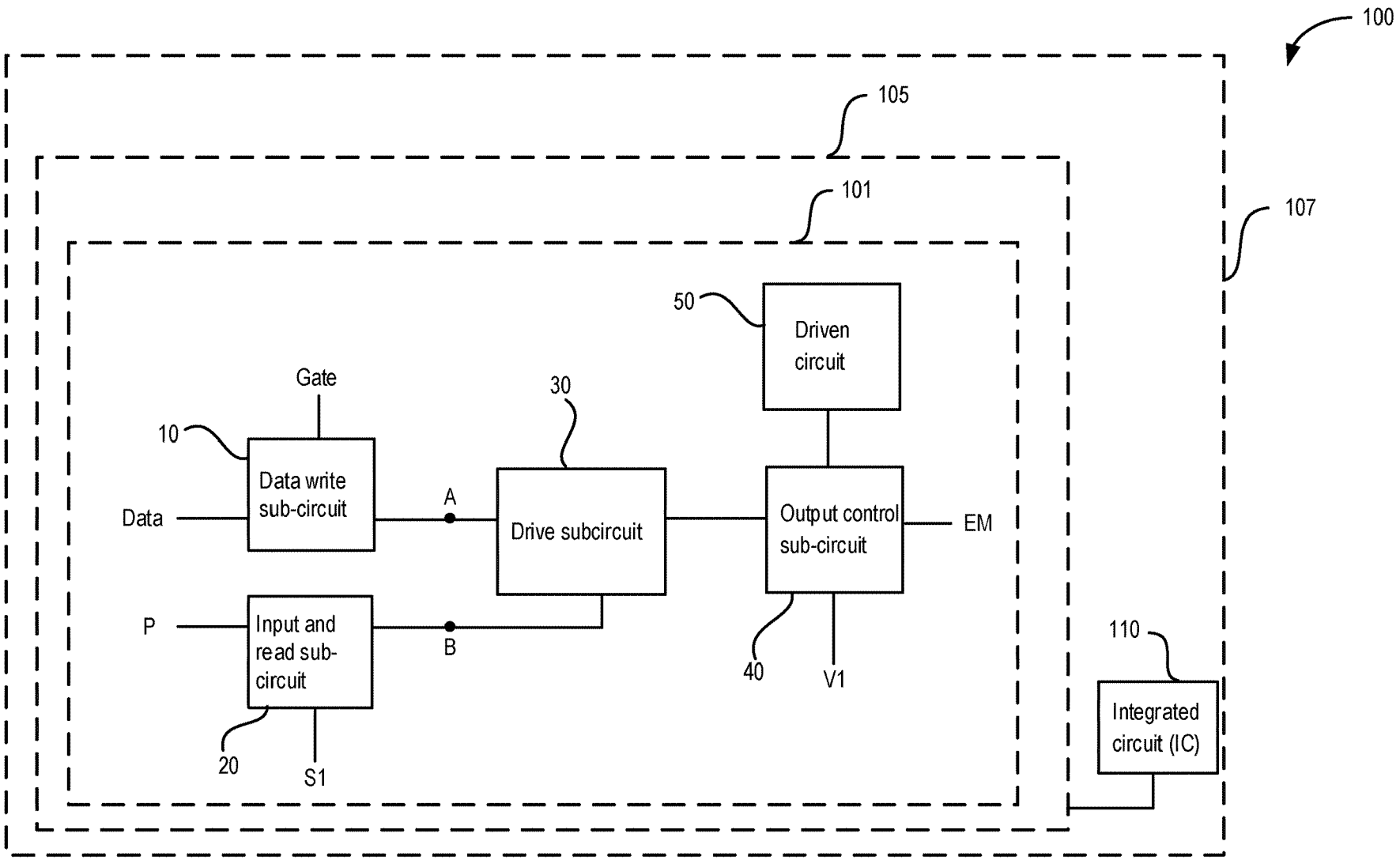
FIG. 1 shows a structural block diagram of a pixel driving circuit according to an embodiment of the present disclosure.

An embodiment of the present disclosure provides a pixel driving circuit 101, as shown in the structural block diagram 100 of FIG. 1, including a data write sub-circuit 10, an input and read sub-circuit 20, a drive sub-circuit 30, and an output control sub-circuit 40. In some embodiments, a display device 107 may comprise an array substrate 105, and the array substrate 105 may include one or more of the pixel circuits 101. Furthermore, the display device may further comprise an integrated circuit 110 connected to the array substrate 105.

Specifically, the data write sub-circuit 10 is connected to the first node (A), the scan signal terminal (Gate), and the data voltage terminal (Data) for transmitting the signals output by the data voltage terminal at different times under control of the scan signal terminal (Gate) to the first node (A).

For example, the data write sub-circuit 10 is connected to the first node (A), the scan signal terminal (Gate), and the data voltage terminal (Data) for outputting the first initialization signal of the data voltage terminal (Data) at different times under control of the scan signal terminal (Gate). The first data signal and the second data signal are respectively transmitted to the first node (A).

Here, in the driving process of the pixel driving circuit 101, the data voltage terminal (Data) outputs the first initialization signal, the first data signal and the second data signal at different times, and each of the data voltage terminal outputs is transmitted to the first node (A).

The input and read sub-circuit 20 is connected to the second node (B), the first signal terminal S1 and the signal transmission terminal (P) for transmitting the signal input from the signal transmission terminal (P) to the second node (B) under control of the first signal terminal S1, or for reading the electrical signal of the second node (B) to the signal transmission terminal (P).

For example, the input and read sub-circuit 20 is connected to the second node (B), the first signal terminal S1, and the signal transmission terminal (P) for outputting the first initialization signal at the data voltage terminal (Data) under control of the first signal terminal S1, and for transmitting the second initialization signal input by the signal transmission terminal (P) to the second node (B) under control of the first signal terminal S1. In the case where the data voltage terminal (Data) outputs the first data signal, the electrical signal of the second node (B) is output to the signal transmission terminal (P). In the case where the data voltage terminal (Data) outputs the second data signal, the potential signal input from the signal transmission terminal (P) is transmitted to the second node (B).

Here, the process of outputting the first initialization signal by the data voltage terminal (Data) and the process of transmitting the second initialization signal by the signal transmission terminal (P) to the second node (B) are in the same stage. The process of outputting the first data signal by the data voltage terminal (Data) and the signal transmission terminal (P), and the process of reading the electric signal of the second node (B) is in the same stage. The process of outputting the second data signal by the data voltage terminal (Data) is at the same stage as the process of transmitting the potential signal to the second node (B) by the signal transmission terminal (P).

In some embodiments, the first signal terminal S1 and the scan signal terminal (Gate) are connected to the same signal input terminal. That is, the signals input by the first signal terminal S1 and the scan signal terminal (Gate) are synchronized.

The signal transmission terminal (P) transmits the potential signal to the second node (B) to avoid the potential of the second node (B) being suspended at this stage, which can affect the normal progress of the display, wherein the specific value of the potential signal transmitted by the signal transmission terminal (P) to the second node (B) at this stage is selected in combination with a specific pixel driving circuit. For example, the specific value of the potential signal may include a ground voltage.

The drive sub-circuit 30 is further connected to the first node (A) and the second node (B) for outputting the driving signal under control of the signal of the first node (A) and the signal of the first voltage terminal V1.

The output control sub-circuit 40 is respectively connected to the drive sub-circuit 30, the driven circuit 50, the enable signal terminal (EM) and the first voltage terminal V1 for transmitting the signal of the first voltage terminal V1, under control of the enable signal terminal (EM), to the drive sub-circuit 30, and for transmitting the driving signal output from the drive sub-circuit 30 to the driven circuit 50.

In one example, the driven circuit 50 herein may include a light-emitting circuit, wherein the light-emitting circuit emits light when driven by the pixel driving circuit 101. The light-emitting circuit may comprise a self-luminous device.

Figure 2:
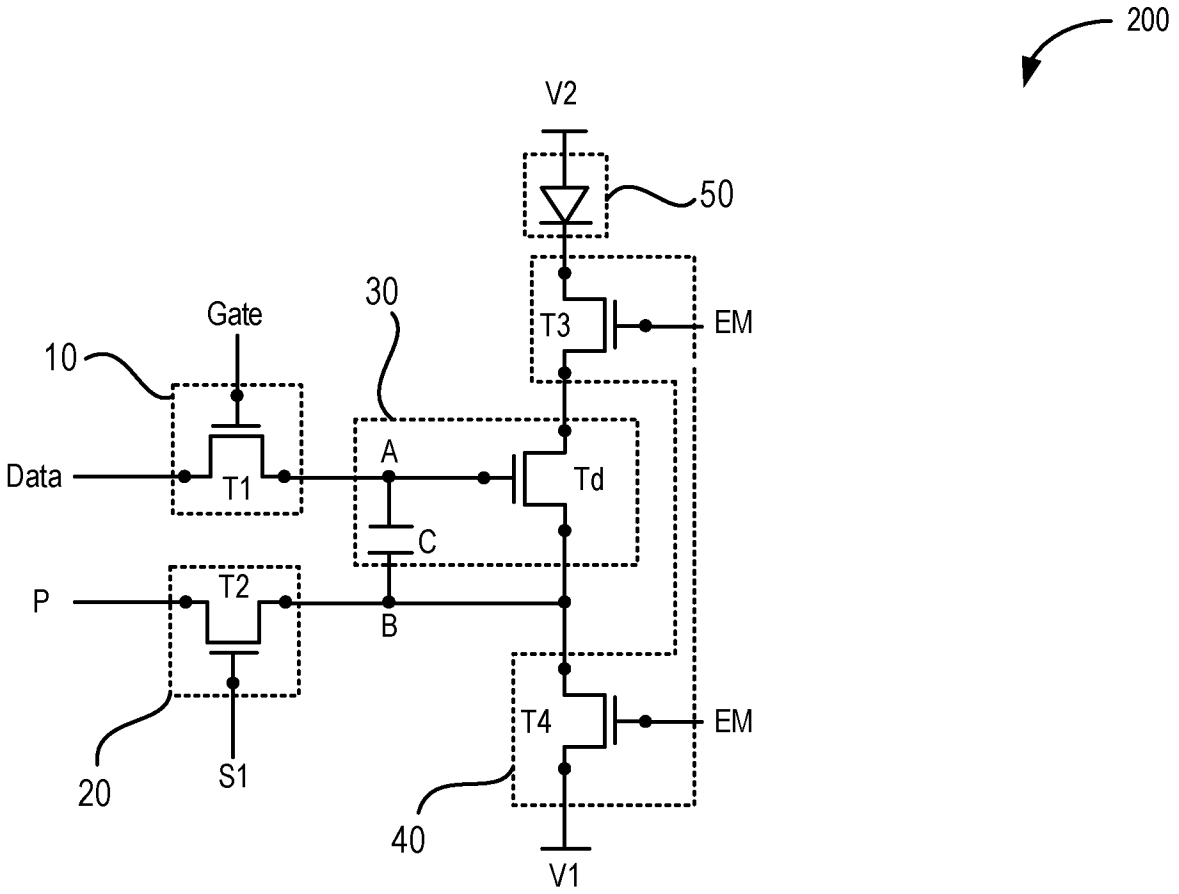
FIG. 2 shows a circuit structural diagram of a pixel unit according to an embodiment of the present disclosure.

In some embodiments, as shown in the pixel unit 200 of FIG. 2, the light-emitting circuit includes a self-luminous device, the gate of the third transistor T3 is connected to the enable signal terminal (EM), the first electrode of the third transistor T3 is connected to the cathode of the self-luminous device, and the second pole of the third transistor T3 is coupled to the first pole of the drive transistor Td.

The gate of the fourth transistor T4 is connected to the enable signal terminal (EM), the first electrode of the fourth transistor T4 is connected to the first voltage terminal V1, and the second electrode of the fourth transistor T4 is connected to the second electrode of the drive transistor Td.

Figure 3:
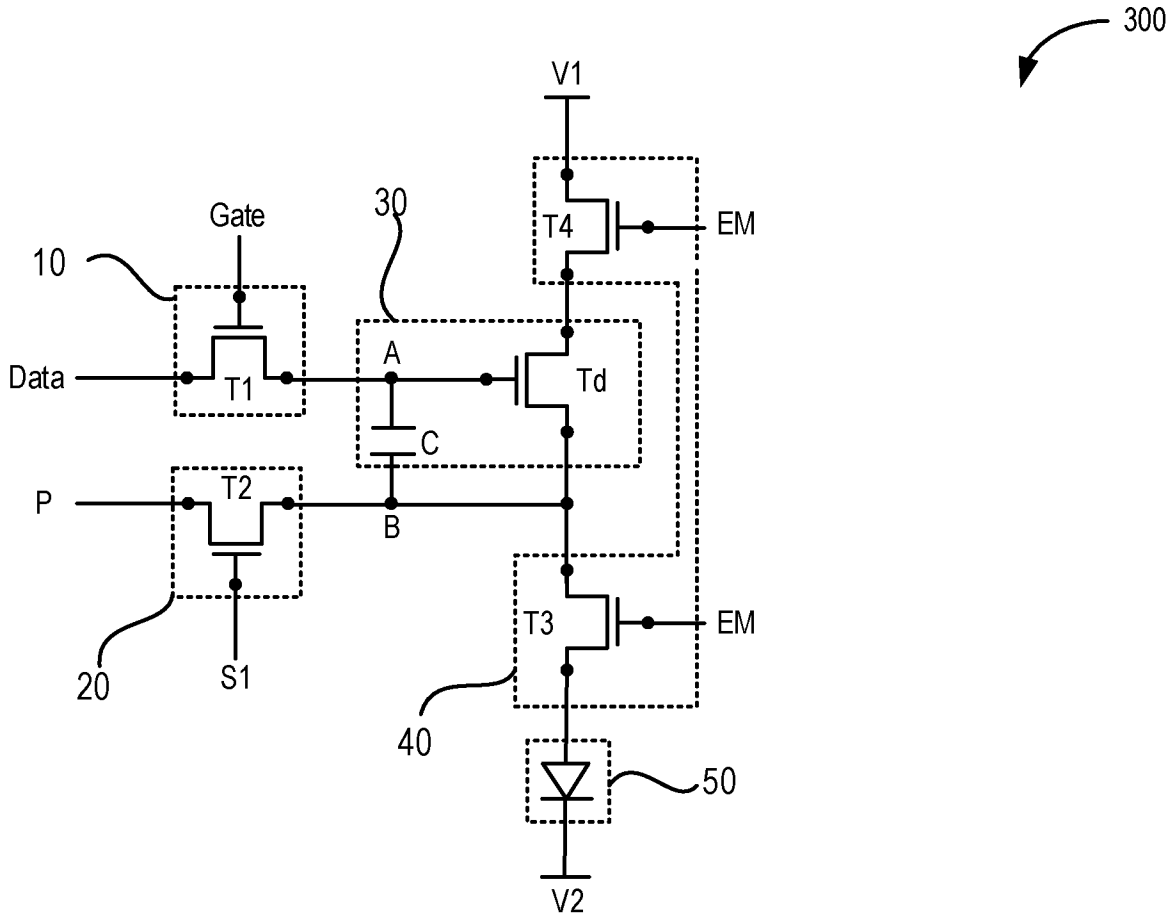
FIG. 3 shows a circuit structural diagram of a pixel unit according to an embodiment of the present disclosure.

In some embodiments, as shown in the pixel unit 300 of FIG. 3, the light-emitting circuit includes a self-luminous device, the gate of the third transistor T3 is connected to the enable signal terminal (EM), the first electrode of the third transistor T3 is connected to the anode of the self-luminous device, and the second pole of the third transistor T3 is coupled to the second pole of the drive transistor Td.

The gate of the fourth transistor T4 is connected to the enable signal terminal (EM), the first electrode of the fourth transistor T4 is connected to the first voltage terminal V1, and the second electrode of the fourth transistor T4 is connected to the first electrode of the drive transistor Td.

In the pixel driving circuit provided by the embodiment of the present disclosure, the driven circuit 50 is driven by the drive current generated by the drive sub-circuit 30, and a threshold voltage generated by the drive sub-circuit 30 is compensated before the drive current is generated, thereby improving performance of the pixel driving circuit by reducing occurrence of the mura phenomenon by decreasing non-uniformities in display brightness caused by the differences in threshold voltage drift.

When the pixel driving circuit provided by the present disclosure is applied to a μLED display panel, the LED is driven by a drive current provided by the pixel driving circuit, and the drive sub-circuit 30 can provide a stable drive current. Since the starting current of the LED is the same, the occurrence of the mura phenomenon arising from the large difference in LED lighting voltage (<1 V) during voltage driving, as evident in the related art, can be reduced, thereby improving performance of the display panel relative to the related art.

In some embodiments a μLED is positioned in a lower portion of a device. An upper portion of the device may have a predominantly high potential while the lower portion has a predominantly low potential. In some embodiments, the potentials are not relevant to the location of μLED or the type of the transistors used.

In some embodiments, as shown in pixel units 200 and 300 of FIGS. 2 and 3 respectively, the data write sub-circuit 10 includes a first transistor T1.

The gate of the first transistor T1 is connected to the scan signal terminal (Gate), the first pole of the first transistor T1 is connected to the data voltage terminal (Data), and the second pole of the first transistor T1 is connected to the first node (A).

It should be noted that the data write sub-circuit 10 may further include a plurality of switching transistors connected in parallel with the first transistor T1. The above description is only one example of the data write sub-circuit 10; other structures having the same functions as the data write sub-circuit 10 may not be described herein, but can be understood to fall within the scope of the present disclosure.

In some embodiments, as shown in FIGS. 2 and 3, the input and read sub-circuit 20 includes a second transistor T2.

The gate of the second transistor T2 is connected to the first signal terminal S1, the first electrode of the second transistor T2 is connected to the signal transmission terminal (P), and the second electrode of the second transistor T2 is connected to the second node (B).

It should be noted that the input and read sub-circuit 20 may further include a plurality of switching transistors connected in parallel with the second transistor T2. The foregoing is merely one example of the input and read sub-circuit 20; other structures having the same function as the input and read sub-circuit 20 may not be described herein again, but are understood to fall within the scope of the present disclosure.

In some embodiments, as shown in pixel units 200 and 300 of FIGS. 2 and 3 respectively, the drive sub-circuit 30 includes a storage capacitor (C) and a drive transistor Td.

The first terminal of the storage capacitor (C) is connected to the first node (A), and the second terminal of the storage capacitor (C) is connected to the second node (B).

The gate of the drive transistor Td is connected to the first node (A), the first electrode of the drive transistor Td is connected to the output control sub-circuit 40, and the second electrode of the drive transistor Td is connected to the second node (B) and the output control sub-circuit 40.

The drive transistor Td is a transistor that supplies a drive current to a self-luminous device, and a function of the drive transistor Td is to convert the gate-source voltage into a drain-source current.

It should be noted that the drive sub-circuit 30 may further include a plurality of transistors connected in parallel with the drive transistor Td. The above is only one example of the drive sub-circuit 30; other structures having the same function as the drive sub-circuit 30 may not be further described herein, but are understood to fall within the scope of the present disclosure.

In some embodiments, as shown in pixel units 200 and 300 of FIGS. 2 and 3 respectively, the output control sub-circuit 40 includes a third transistor T3 and a fourth transistor T4.

The gate of the third transistor T3 is connected to the enable signal terminal (EM), the first electrode of the third transistor T3 is connected to the driven circuit 50, and the second electrode of the third transistor T3 is connected to the drive sub-circuit 30.

The gate of the fourth transistor T4 is connected to the enable signal terminal (EM), the first electrode of the fourth transistor T4 is connected to the first voltage terminal V1, and the second electrode of the fourth transistor T4 is connected to the drive sub-circuit 30.

It should be noted that the output control sub-circuit 40 may further include a plurality of switching transistors connected in parallel with the third transistor T3, and/or a plurality of switching transistors connected in parallel with the fourth transistor T4. The foregoing is only one example of the output control sub-circuit 40; other structures having the same function as the output control sub-circuit 40 may not be described herein, but are understood to fall within the scope of the present disclosure.

In one example, the driven circuit of pixel units 200 and 300 of FIG. 2 and FIG. 3 respectively, may include a self-luminous device, and the driven circuit 50 may also be connected to the second voltage terminal V2, but is not limited thereto.

In the pixel driving circuit provided by the embodiment of the present disclosure, the drive sub-circuit 30 includes a drive transistor Td. According to the characteristics of the transistor, when the gate is given a certain voltage, the drain voltage changes accordingly, and the drain potential rises to Vg (gate voltage)−Vs (source voltage)=Vth (threshold voltage), so that the drive transistor Td is operated in the saturation region, which satisfies the condition, Vgs (gate-source voltage)−Vth>Vds (drain-source voltage), that is, Vgd (gate-drain voltage)>Vth. Utilizing the saturation characteristics of the drive transistor, the system may provide a stable current output over a wide range of Vds, which effectively improves the performance of the pixel driving circuit by reducing occurrence of the mura phenomenon caused by uneven brightness due to different starting voltages of the self-luminous device.

In addition, the pixel driving circuit provided by an embodiment of the present disclosure is advantageously simple in structure, comprising five transistors and one storage capacitor (C), is low cost and has a large aperture ratio, and can be applied to a high PPI (pixels per inch) product.

The specific driving process of the above pixel driving circuit, as related to the above description of the specific sub-circuits of the pixel driving circuit, will be described in detail below with reference to FIGS. 2 and 4.

It should be noted that, in the first embodiment of the present disclosure, the types of transistors in each sub-circuit are not limited; that is, the transistor types of the first transistor T1, the second transistor T2, the third transistor T3, the fourth transistor T4, and the drive transistor Td, are not limited. For example, the transistors in each sub-circuit may include an N-type transistor or a P-type transistor. For exemplary purposes, the following embodiments of the present disclosure are described employing N-type transistors for the above-described transistors.

In the present disclosure, the first pole of a transistor may be a drain, and the second pole of a transistor may be a source; or, in other examples, the first pole may be a source, and the second pole may be a drain, and is not limited by the embodiment of the present disclosure.

Further, the transistors in the above-described pixel driving circuit can be classified as an enhancement-type transistor or a depletion-type transistor, depending on the manner in which the transistors are electrically conductive, and is not limited by the embodiment of the present disclosure.

Second, in the embodiment of the present disclosure, the first voltage terminal V1 is input with a lower level VS S, and the second voltage terminal V2 is input with a higher level VDD. The first voltage terminal V1 may also be grounded, wherein higher and lower values only indicate the relative magnitude relationship between the input voltages.

Figure 4:
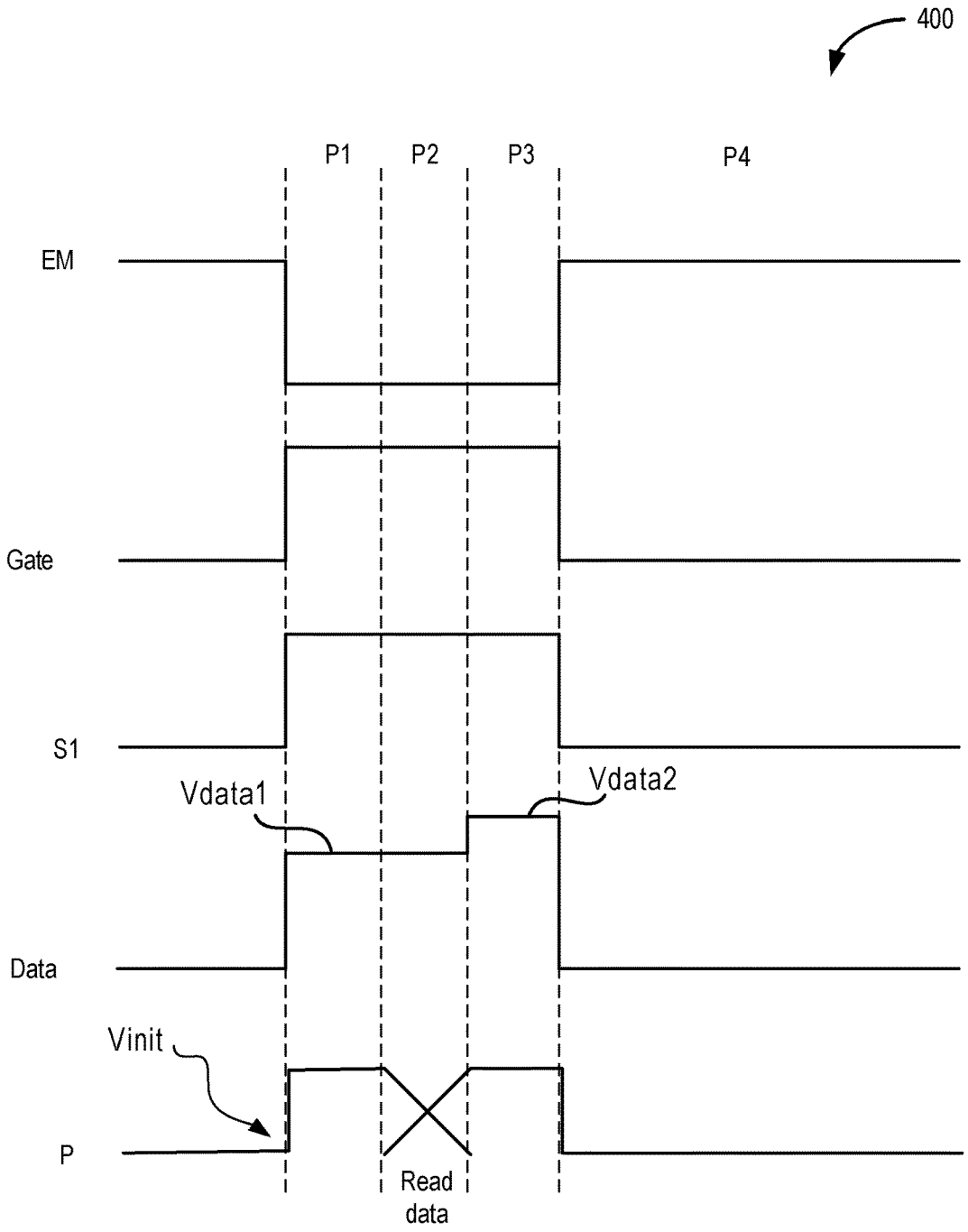
FIG. 4 shows a circuit timing diagram of the pixel unit of FIG. 2.
Figure 5:
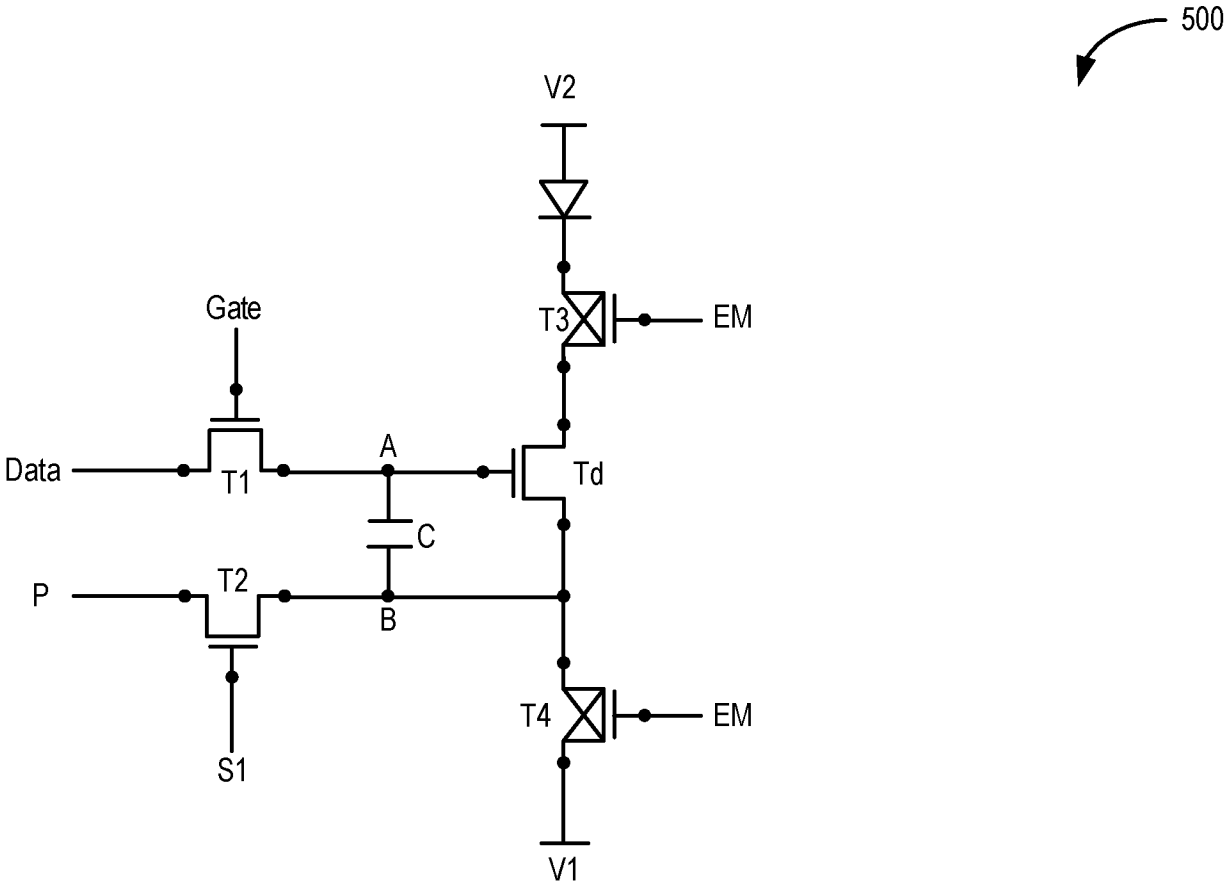
FIGS. 5 and 6 show circuit structural diagrams illustrating a driving process of the pixel unit of FIG. 2.

As shown in circuit timing diagram 400 of FIG. 4, the driving process of the pixel driving circuit may be divided into a first stage P1, a second stage P2, a third stage P3, and a fourth stage P4. Specifically, During the first stage P1:

As shown in circuit timing diagram 400 of FIG. 4, the scan signal terminal (Gate) and the first signal terminal S1 input a higher level ON signal, and the enable signal terminal (EM) inputs a lower level OFF signal. FIG. 5 illustrates the circuit diagram 500 for a driving process of a pixel driving circuit of pixel unit 200 shown in FIG. 2 corresponding to the first stage P1.

The first transistor T1, the second transistor T2, and the drive transistor Td are all turned ON, and the third transistor T3 and the fourth transistor T4 are both turned OFF, (the transistor in the OFF state is indicated by "x").

Accordingly, the scan signal terminal (Gate) inputs a higher level turn ON signal to turn ON the first transistor T1, and the first initialization signal input at the data voltage terminal (Data) (the first initialization signal is equal to the first data signal Vdata1 in FIG. 4 as an example) is transmitted to the first node (A) via the first transistor T1 to initialize the potential of the first node (A). In the example of FIG. 4, the first initialization signal is equal to the first data signal Vdata1. The first signal terminal S1 inputs a higher level turn ON signal to turn ON the second transistor T2, and the second initialization signal Vinit, input from the signal transmission terminal (P), is transmitted to the second node (B) via the second transistor T2.

At the end of the first stage P1, the potential of the first node (A) is Vdata1, and the potential of the second node (B) is Vinit.

In the second stage P2:

As shown in circuit timing diagram 400 of FIG. 4, the scan signal terminal (Gate) and the first signal terminal S1 input a higher level ON signal, and the enable signal terminal (EM) inputs a lower level OFF signal. FIG. 5 illustrates the circuit diagram 500 for the pixel driving circuit of pixel unit 200 shown in FIG. 2 corresponding to the second stage P2.

The first transistor T1, the second transistor T2, and the drive transistor Td are all turned ON, and the third transistor T3 and the fourth transistor T4 are both turned OFF.

The scan signal terminal (Gate) inputs a higher level turn ON signal, to turn ON the first transistor T1, and the first data signal Vdata1 input by the data voltage terminal (Data) is transmitted to the first node (A) via the first transistor T1. The first signal terminal S1 inputs a higher level ON signal to turn ON the second transistor T2, and the signal transmission terminal (P) reads the second node (B) electrical signal. When the second node (B) has no external power input signal, the potential of the second node (B) changes according to the gate voltage of the drive transistor Td (the potential of the first node (A)), and the drive transistor Td is turned off when the voltage difference between the potential of the first node (A) and the second node (B) is reduced to Vth.

At the end of the second stage P2, the potential of the first node (A) is Vdata1, and the potential of the second node (B) is Vdata1−Vth.

The threshold voltage Vth of the drive transistor Td is obtained by comparing the potential of the second node (B) with the potential of the first node (A), and the threshold voltage Vth is increased to the second data signal in the data writing stage P3.

The third stage P3:

As shown in circuit timing diagram 400 of FIG. 4, the scan signal terminal (Gate) and the first signal terminal S1 input a higher level ON signal, and the enable signal terminal (EM) inputs a lower level OFF signal. FIG. 5 illustrates the circuit diagram 500 for the pixel driving circuit of pixel unit 200 shown in FIG. 2 corresponding to the third stage P3.

The first transistor T1, the second transistor T2, and the drive transistor Td are all turned ON, and the third transistor T3 and the fourth transistor T4 are both turned OFF.

The scan signal terminal (Gate) inputs a higher level turn ON signal to turn ON the first transistor T1, and the second data signal Vdata2 input by the data voltage terminal (Data) is transmitted to the first node (A) via the first transistor T1. The first signal terminal S1 inputs a higher level turn ON signal to turn ON the second transistor T2, and the potential signal input from the signal transmission terminal (P) is transmitted to the second node (B).

In one example, the potential signal input from the signal transmission terminal (P) may be equal to the second initialization signal Vinit, and the second data signal Vdata2=Vdata1+Vth.

At the end of the third stage P3, the potential of the first node (A) is Vdata2, and the potential of the second node (B) is Vinit.

In some embodiments, the second initialization signal Vinit is equal to the low level VSS of the first voltage terminal V1 to prevent the potential at the second node (B) jumping from Vinit to VSS during the fourth stage (P4). A jump in the potential at the second node (B) from Vinit to VSS during the fourth stage (P4) may cause a jump in the potential at the first node (A) leading to changes in Vgs, which affects the illuminating current.

Figure 6:
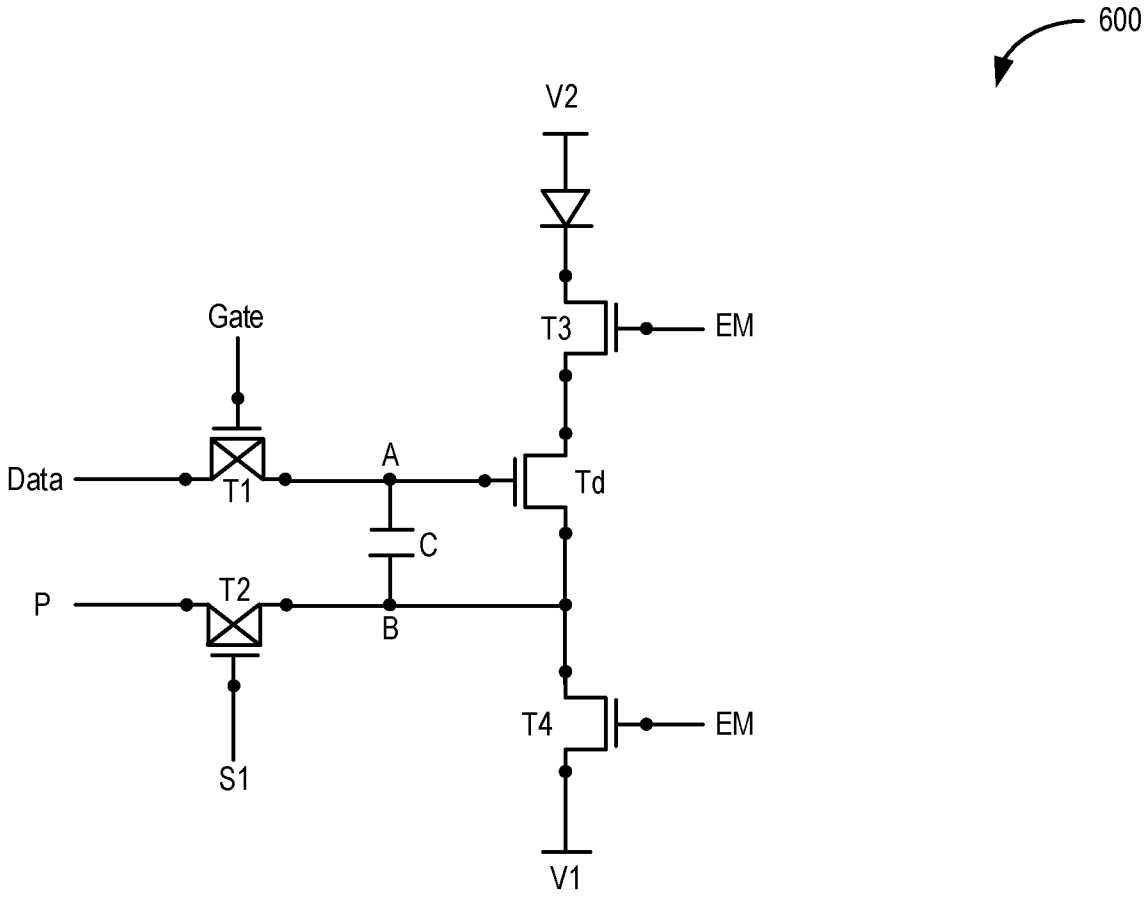

Fourth stage P4:

As shown in circuit timing diagram 400 of FIG. 4, the enable signal terminal (EM) inputs a higher level turn ON signal, and the scan signal terminal (Gate) and the first signal terminal S1 inputs a lower level turn OFF signal. FIG. 6 illustrates the circuit diagram 600 for the pixel driving circuit of pixel unit 200 shown in FIG. 2 corresponding to the fourth stage P4.

The third transistor T3, the fourth transistor T4, and the drive transistor Td are all turned ON, and the first transistor T1 and the second transistor T2 are both turned OFF.

The enable signal terminal (EM) inputs a higher level turn ON signal to turn ON the third transistor T3 and the fourth transistor T4 to connect the drive transistor Td and the self-luminous device. The power supply voltage VDD output by the second voltage terminal V2 is transmitted to the anode of the self-luminous device. The saturation circuit generated by the drive transistor Td flows to the cathode of the self-luminous device, and is driven by driving the driving signal output from the drive transistor Td and the power supply voltage VDD output from the second voltage terminal V2.

In the fourth stage P4, the voltage of the first node (A) is Vdata2, and the voltage of the second node (B) is VSS. Vgs=Vg−Vs=Vdata2−VSS=Vdata1+Vth−VSS of the drive transistor Td.

After the drive transistor Td is turned on, when the value of the gate-source voltage Vgs of the drive transistor Td minus the threshold voltage Vth of the drive transistor Td is less than or equal to the drain-source voltage Vds of the drive transistor Td, that is, Vgs−Vth≤Vds, the drive transistor Td can be in a saturated ON state, at which time the drive current flowing through the drive transistor Td is given by:

$$I_{led} = \frac{1}{2}\mu C_{OX}\frac{W}{L}(Vgs - Vth)^2 = \frac{1}{2}\mu C_{OX}\frac{W}{L}(Vdata1 + Vth - VSS - Vth)^2 = \frac{1}{2}\mu C_{OX}\frac{W}{L}(Vdata1 - VSS)^2$$

Where W/L is the width to length ratio of the drive transistor Td, which is the dielectric constant of the channel insulating layer, and represents the channel carrier mobility.

The above parameters are only related to the structure of the drive transistor Td, the first data voltage Vdata1 output by the data voltage terminal (Data), and the VSS output by the first voltage terminal V1, and are independent of the threshold voltage Vth of the drive transistor Td, thereby eliminating the influence of the threshold voltage Vth of the drive transistor Td on the luminance of the self-luminous device, and increasing the uniformity of the brightness of the self-luminous device.

Figure 7:
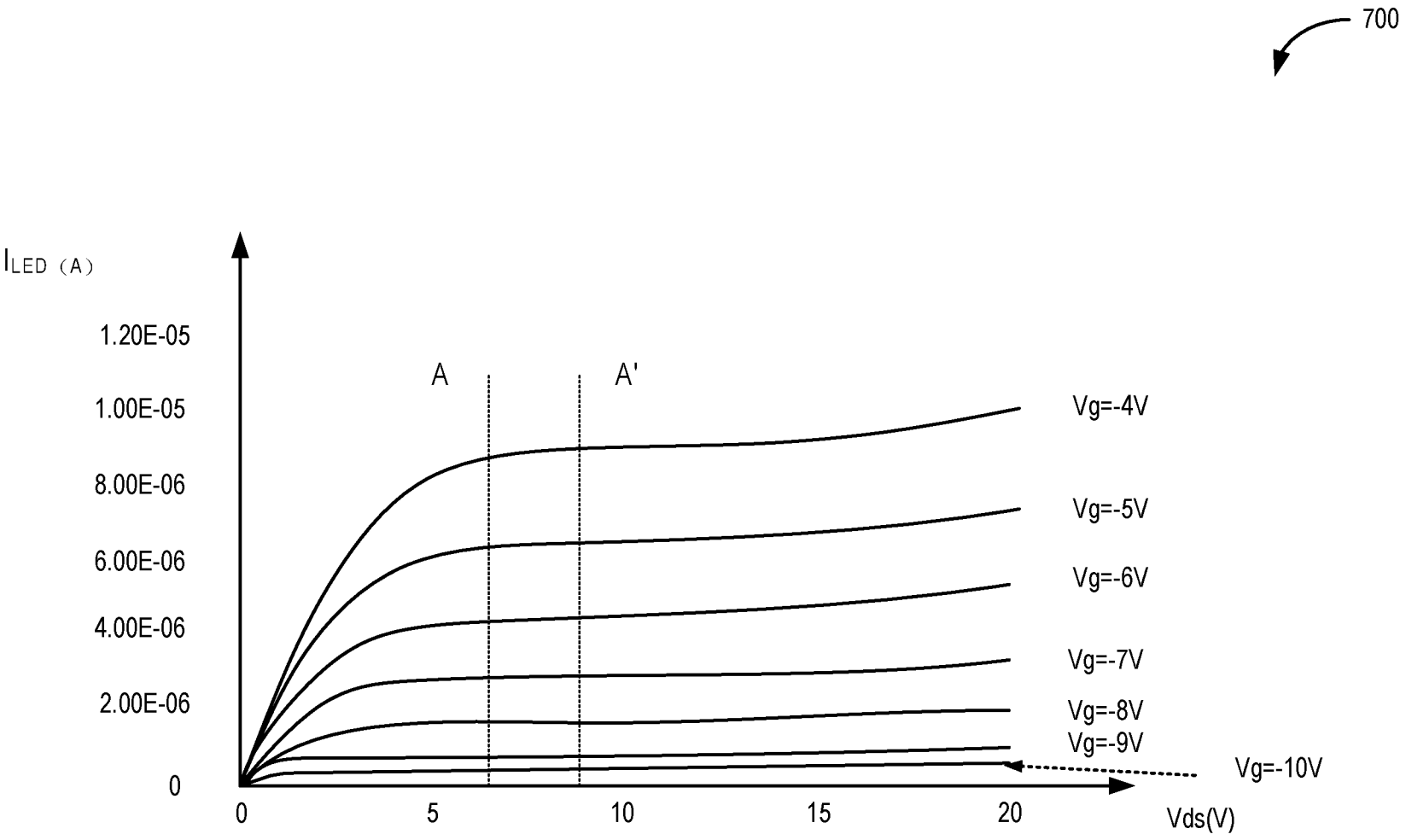
FIG. 7 shows a plot illustrating the performance of a drive transistor according to an embodiment of the present disclosure.

FIG. 7 illustrates a plot 700 showing the output characteristic curve of the drive transistor Td, the X axis showing the Vds voltage, and the Y axis showing the current generated by the thin film transistor (TFT), ILED. As can be seen from FIG. 7, the Vds voltage exists in a region (for example, in the range of AA'), in which the current generated by the different Vgs voltages is in a plateau region. Accordingly, the driving mode of the current-driven LED provided by the present disclosure is selected so that the drive transistor Td is operated in the A-A' region to generate a stable drive current. Consequently, this current driving method for illuminating the LEDs of the μLED device reduces an occurrence of the mura phenomenon caused by differences in the LED lighting voltage.

Embodiments of the present disclosure also provide a pixel unit including the above pixel driving circuit and light-emitting circuit.

The light-emitting circuit is connected to the output control sub-circuit 40 of the pixel driving circuit and the second voltage terminal V2 for emitting light when driven by the driving signal output from the pixel driving circuit and the signal of the second voltage terminal V2.

The first voltage terminal V1 and the second voltage terminal V2 include higher and lower voltage terminals, and their relative values are related to their relative positions at the two ends of the light-emitting circuit. For example, the first voltage terminal V1 may be input with a higher level VDD, and the second voltage terminal V2 may be input with a lower level VSS. Alternately, the first voltage terminal V1 may be input with a lower level VSS, and the second voltage terminal V2 may be input with a higher level VDD.

The pixel unit provided by the embodiment of the present disclosure includes the above-mentioned pixel driving circuit, and the beneficial effects thereof are the same as those of the above pixel driving circuit, details of which are not repeatedly described herein.

In the case where the light-emitting circuit includes a self-luminous device, the anode of the self-luminous device is connected to the voltage terminal of the higher level VDD, and the cathode is connected to the voltage terminal of the lower level VSS. Accordingly, as shown in FIG. 1, if the anode of the self-luminous device is connected to the second voltage terminal V2, the second voltage terminal V2 inputs a higher level VDD; if the cathode of the self-luminous device is connected to the second voltage terminal V2, the second voltage terminal V2 inputs a lower level VSS.

In some embodiments, the signals output by the first voltage terminal V1 and the second voltage terminal V2 are a higher level signal and a lower level signal, respectively, and the potential signal is output by the voltage terminal of the lower level signal.

As an example, the signal transmission terminal (P) transmits the potential signal to the second node (B) to the low level VSS, and the signal transmission terminal (P) transmits the second initialization signal to the second node (B) to the low level VSS.

In some embodiments, as shown in FIG. 2, the light-emitting circuit includes a self-luminous device 50.

The anode of the self-luminous device is connected to the second voltage terminal V2, the cathode of the self-luminous device is connected to the first pole of the third transistor T3, and the signal output by the second voltage terminal V2 is a higher level signal with respect to the signal output by the first voltage terminal V1.

In some embodiments, as shown in the pixel unit 300 of FIG. 3, the light-emitting circuit includes a self-luminous device The anode of the self-luminous device is connected to the first pole of the third transistor T3, the cathode of the self-luminous device is connected to the second voltage terminal V2, and the signal output by the second voltage terminal V2 is a lower level signal with respect to the signal output by the first voltage terminal V1.

An embodiment of the present disclosure further provides an array substrate 105, including the above pixel unit.

When the array substrate 105 is applied to the display device 107, the integrated circuit 110 connected to the signal transmission terminal (P) has both a function of outputting a signal to the signal transmission terminal (P) and a function of reading a signal of the signal transmission terminal (P). The integrated circuit 110 can be directly connected to the signal transmission terminal (P), or can be connected to the signal transmission terminal (P) through other sub-circuits.

The array substrate 105 provided by the embodiment of the present disclosure includes a plurality of sub-pixel arrays, and each sub-pixel array includes any one of the pixel units described above. The array substrate 105 provided by the embodiment of the present disclosure has the same advantageous effects as the pixel unit provided by the foregoing embodiments of the present disclosure. Since the pixel unit has been described in detail in the foregoing embodiments, those details may not be described herein again.

In some embodiments, the array substrate 105 comprises a glass substrate and the pixel unit is disposed on the glass substrate.

Figure 8:
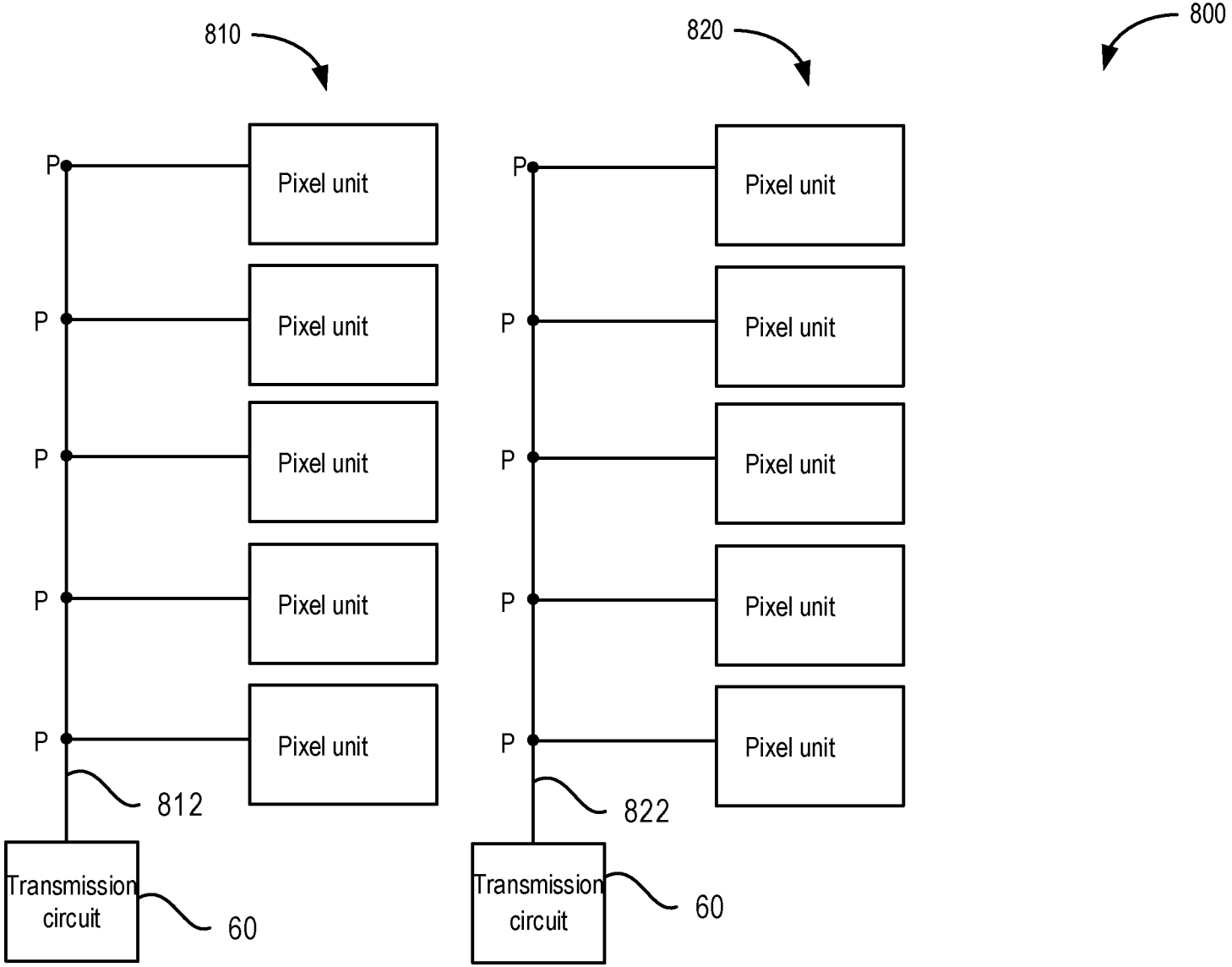
FIG. 8 shows a structural block diagram of an array substrate according to an embodiment of the present disclosure.

In some embodiments, as shown in the structural block diagram 800 of FIG. 8, the array substrate 105 further includes a plurality of transmission circuits 60, one or more columns of pixel units 810 and 820, wherein each pixel unit is correspondingly connected to a transmission circuit 60, and the transmission circuit 60 is connected to the signal transmission terminal (P). The transmission circuit 60 is used for inputting a signal to the signal transmission terminal (P) connected to the transmission circuit 60, or for reading an electrical signal of the second node (B) output from the signal transmission terminal (P).

For example, the transmission circuit 60 may be used for inputting a second initialization signal or a potential signal to the signal transmission terminal (P) connected to the transmission circuit 60.

Each of the pixel driving circuits is connected to the transmission circuit 60 through the signal transmission terminal (P). A pixel driving circuit may be connected to one transmission circuit 60, or a transmission circuit 60 may be connected to a plurality of, or all of, the pixel driving circuits by way of the same data line (e.g., data lines 812, 822).

In some embodiments, the structure in which the integrated circuit 110 is connected to the pixel unit through the transmission circuit 60 is selected in order to reduce the amount of routing on the array substrate 105 and to reduce the connection ports of the integrated circuit 110.

In order to reduce the number of connection sub-circuits, in some embodiments, as shown in structural block diagram 800 of FIG. 8, the array substrate 105 may further include a data line that is parallel with the connecting line of the transmission circuit providing data voltage connected to the data voltage terminal (Data), and a column of pixel units 810 and 820 connected to the same data line is connected to the same transmission circuit 60.

In one example, each pixel unit may comprise a transmission circuit 60, wherein the pixel driving circuit 101 includes the transmission circuit 60. Additionally and/or alternatively, an array of pixel units may share one transmission circuit 60. The transmission circuit can be arranged in or surrounding non-display areas of the display device, instead of being arranged in the active area zone. In one embodiment, only one line or array of pixels is turned ON, and the scanning may be performed in a line-by-line manner.

Figure 9:
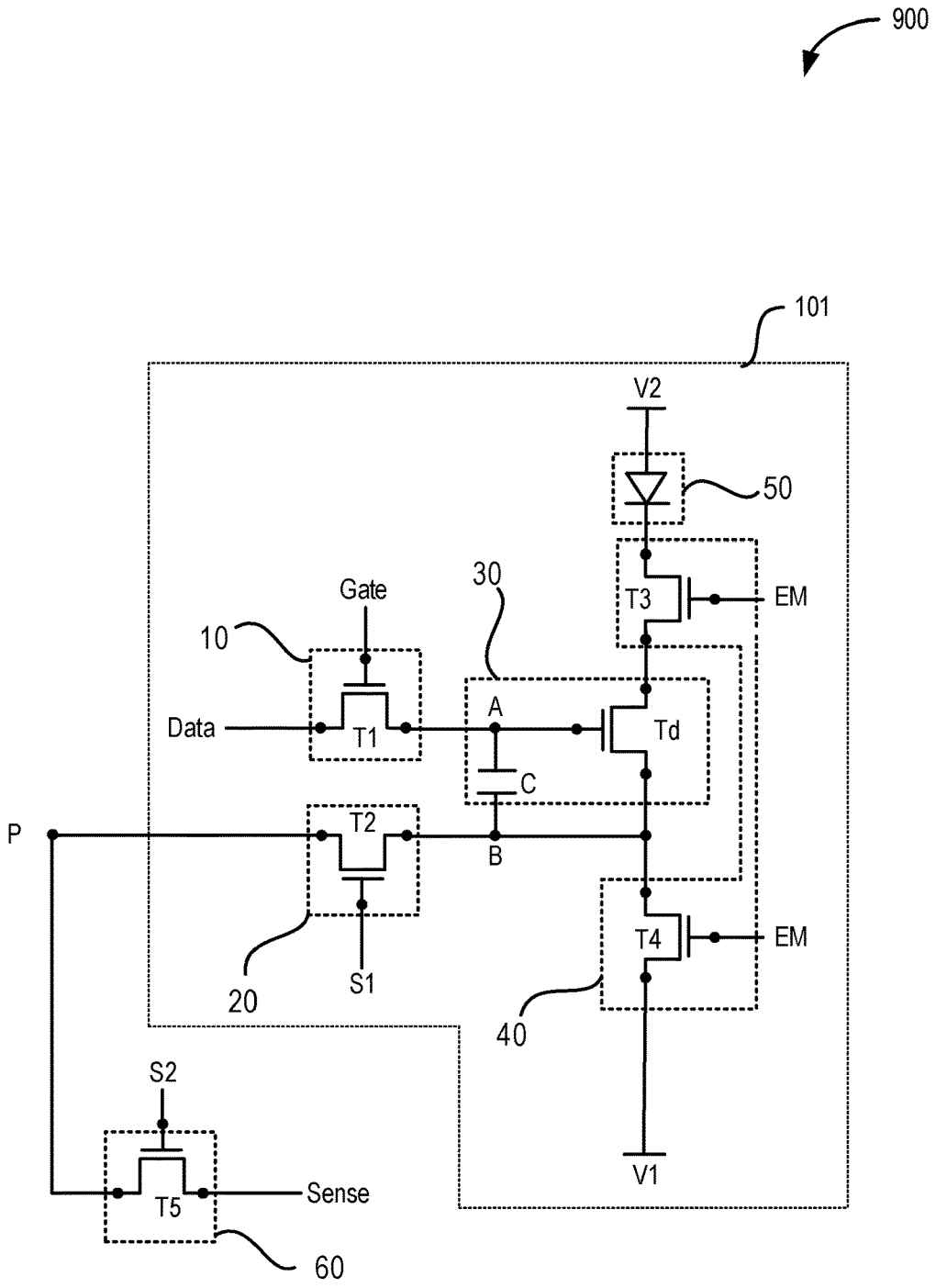
FIG. 9 shows a circuit structural diagram of a pixel driving circuit in the array substrate of FIG. 8.

In order to reduce the number of transistors, in some embodiments, as shown in the circuit structural diagram 900 of FIG. 9, the transmission circuit 60 includes a fifth transistor T5. A gate of the fifth transistor T5 is connected to the second signal terminal S2, the first pole of the fifth transistor T5 is connected to the signal transmission terminal (P), and the second pole of the fifth transistor T5 is connected to the read signal line (Sense). The read signal line (Sense) is used for transmitting the signal input to the signal transmission terminal (P), or for transmitting an electrical signal output from the signal transmission terminal (P) to the second node (B).

For example, the read signal line (Sense) is used to transmit a second initialization signal or potential signal input to the signal transmission terminal (P), or to transmit the electrical signal of the second node (B) output from the signal transmission terminal (P).

Taking the fifth transistor T5 as an N-type transistor as an example, in the pixel unit driving process, during the first stage (e.g., P1), the second stage (e.g., P2), and the third stage (e.g., P3), the second signal terminal S2 inputs a higher level ON signal, and during the fourth stage (e.g., P4), the second signal terminal S2 inputs a lower level OFF signal.

That is to say, the integrated circuit 110 connected to the read signal line (Sense) can output the second initialization signal or the potential signal to the read signal line (Sense), and can read the electric signal on the read signal line (Sense).

Driving voltages for μLEDs are lower (e.g., ~2V) relative to conventional LEDs such as OLEDs, and voltage is not applied to the μLEDs prior to their illumination; therefore, structures such as transistors T3 and T4 are utilized in the pixel driving circuit described herein. In this way, the μLED driving circuit shown in FIG. 9 is different from a conventional OLED driving circuit. Furthermore, the OLED driving circuit cannot be easily modified for application to a μLED driving circuit.

Figure 10:
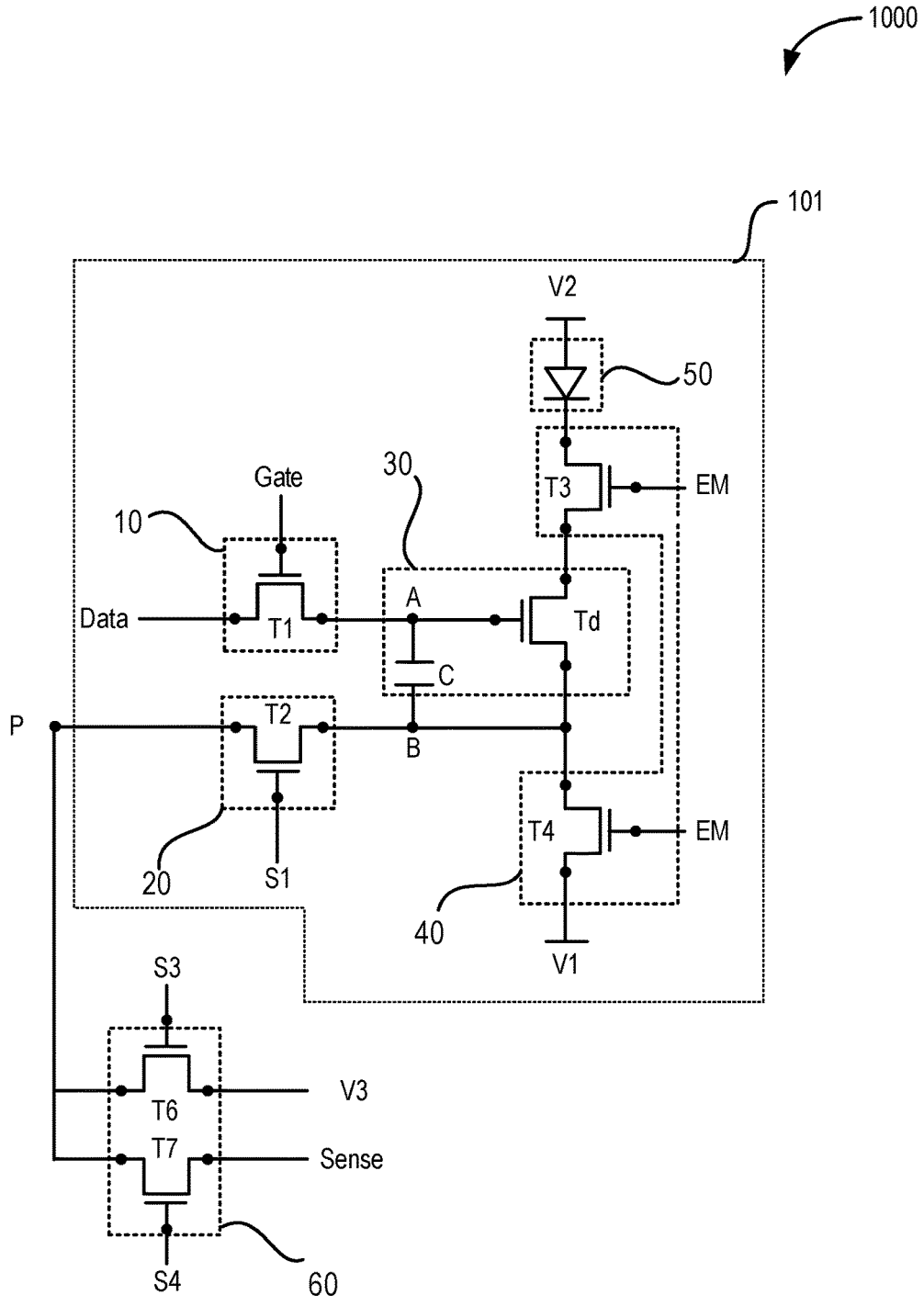
FIG. 10 shows a circuit structural diagram of a pixel driving circuit in the array substrate of FIG. 8.

In order to simplify the integrated circuit 110, in some embodiments, as shown in circuit structural diagram 1000 of FIG. 10, the transmission circuit 60 includes a sixth transistor T6 and a seventh transistor T7. The gate of the sixth transistor T6 is connected to the third signal terminal S3, a first pole of the sixth transistor T6 is connected to the signal transmission terminal (P), a second pole of the sixth transistor T6 is connected to the third voltage terminal V3, a gate of the seventh transistor T7 is connected to the fourth signal terminal S4, a first pole of the seventh transistor T7 is connected to the signal transmission terminal (P), and a second pole of the seventh transistor T7 is connected to the read signal line (Sense).

For example, the third voltage terminal V3 is used to input a second initialization signal or a potential signal, and the read signal line (Sense) is used to transmit the electrical signal of the second node (B) output by the signal transmission terminal (P).

Figure 11:
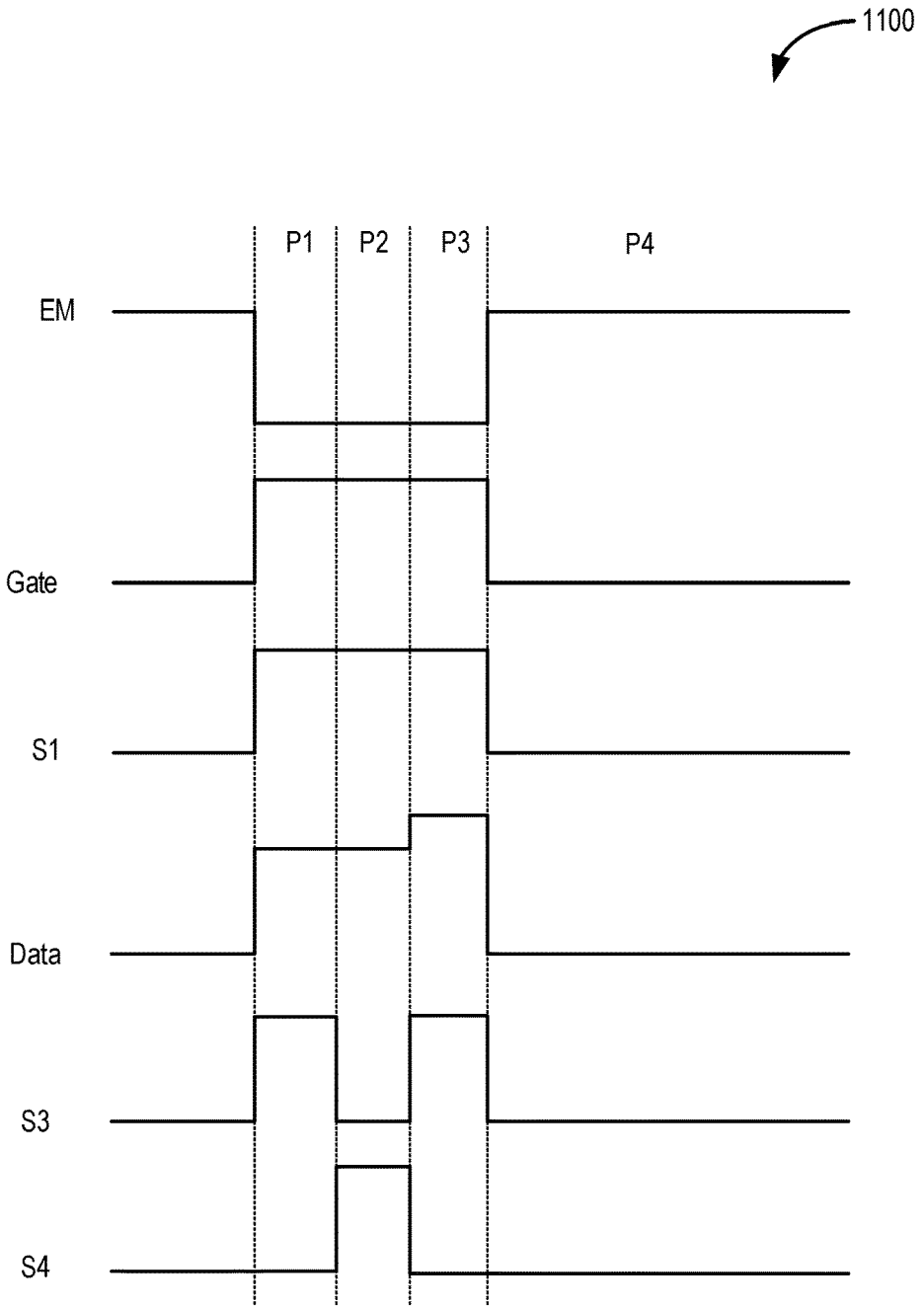
FIG. 11 shows a circuit timing diagram illustrating a driving process for each pixel driving circuit of FIG. 10.

Taking the sixth transistor T6 and the seventh transistor T7 as N-type transistors as an example, in the pixel unit driving process, as shown in circuit timing diagram 1100 of FIG. 11, during the first stage P1, the third signal terminal S3 inputs a higher level ON signal, the second initialization signal of the third voltage terminal V3 is transmitted to the signal transmission terminal (P) by way of the sixth transistor T6, the fourth signal terminal S4 is input with the lower level OFF signal, and the seventh transistor T7 is turned OFF. During the second stage P2, the fourth signal terminal S4 inputs a higher level ON signal, the electrical signal of the second node (B) read by the signal transmission terminal (P) is transmitted to the read signal line (Sense) via the seventh transistor T7, the lower level OFF signal is input to the third signal terminal S3, and the sixth transistor T6 is turned OFF. During the third stage P3, the third signal terminal S3 inputs a higher level ON signal, the potential signal of the third voltage terminal V3 is transmitted to the signal transmission terminal (P) via the sixth transistor T6, the fourth signal terminal S4 inputs a lower level OFF signal, and the seventh transistor T7 is turned OFF. During the fourth stage P4, the third signal terminal S3 and the fourth signal terminal S4 are both input with a lower level OFF signal, and the sixth transistor T6 and the seventh transistor T7 are turned off.

That is, the integrated circuit 110 connected to the read signal line (Sense) is used to read the electrical signal on the read signal line (Sense), and the integrated circuit 110 connected to the third voltage terminal V3 is used to output the second initialization signal or a potential signal to the third voltage terminal V3.

The embodiment of the present disclosure further provides a display device 107 comprising the above array substrate 105, further comprising an integrated circuit 110 connected to the signal transmission terminal (P). The integrated circuit 110 is configured to receive the electrical signal of the second node (B) output by the signal transmission terminal (P) to obtain the threshold voltage Vth of the drive sub-circuit 30 and generate a compensated data signal.

For example, the integrated circuit 110 compensates the first data signal by comparing the electrical signal of the second node (B) with the first data signal to generate a second data signal.

The signal transmission terminal (P) may be directly connected to the integrated circuit 110 or may be indirectly connected to the integrated circuit 110.

The threshold voltage Vth of the drive sub-circuit 30 can be obtained by comparing the electrical signal of the second node (B) with the first data signal. Performing compensation of the threshold voltage Vth includes increasing the threshold voltage Vth based on the first data signal to obtain the second data signal.

In some embodiments, the array substrate 105 includes a transmission circuit 60 that connects the read signal line (Sense) connected to the transmission circuit 60, and the electrical signal of the second node (B) output by the signal transmission terminal (P) is transmitted to the integrated circuit 110 by way of the read signal line (Sense).

The display device 107 may specifically be a product or component having any display function, such as a μLED display, a digital photo frame, a mobile phone, a tablet computer, or a navigator.

The display device 107 provided by the embodiment of the present disclosure includes the above array substrate 105, the array substrate 105 has a plurality of pixel unit arrays, and each of the pixel units includes any one of the pixel driving circuits 101 described above. The display device 107 provided by the embodiment of the present disclosure has the same advantageous effects as the pixel driving circuit 101 provided by the foregoing embodiments of the present disclosure. Since the pixel driving circuit 101 has been described in detail in the foregoing embodiments, details may not be described herein again.

Figure 15:
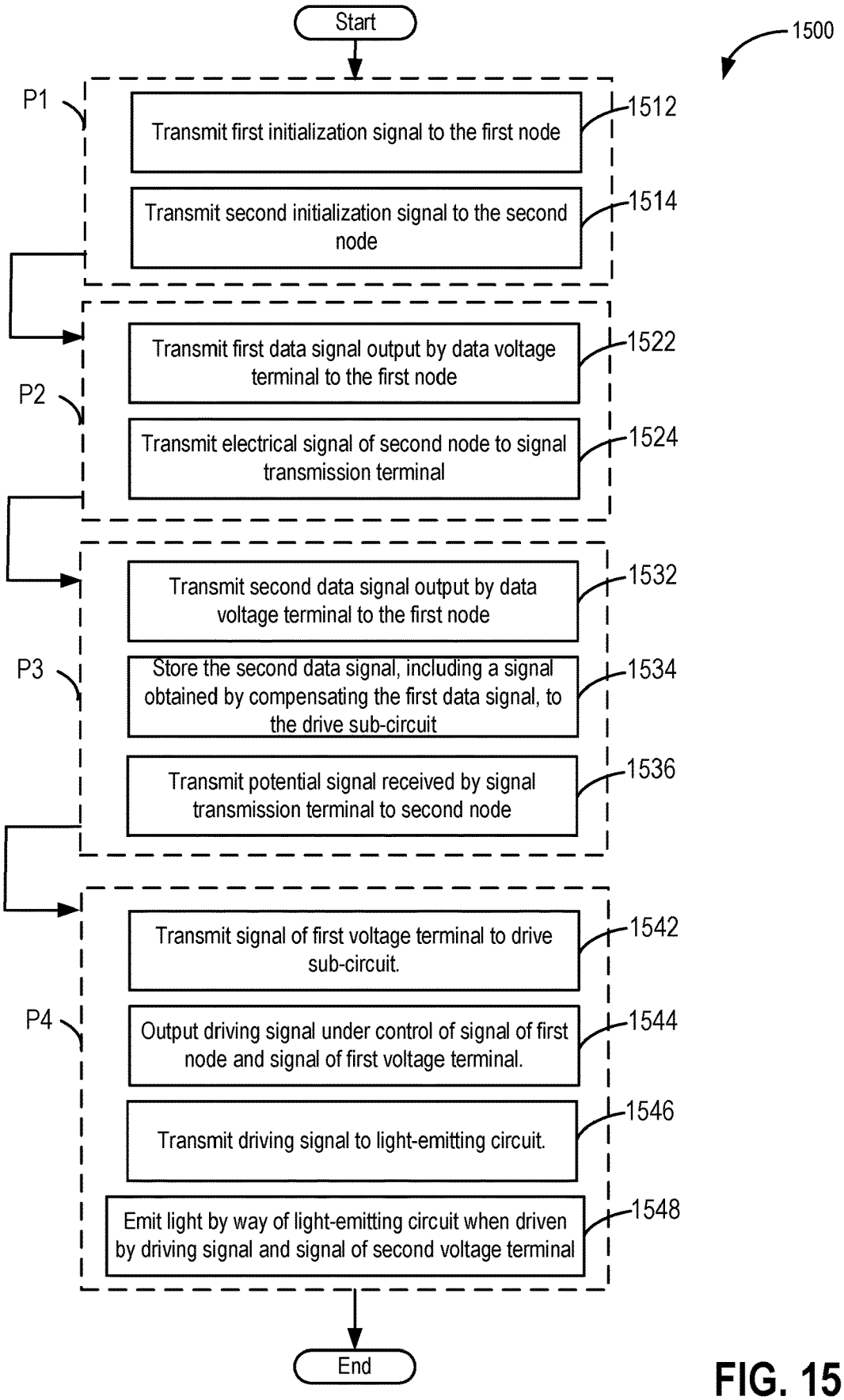
FIG. 15 shows a flow chart for a method of driving a pixel unit according to an embodiment of the present disclosure.

The embodiment of the present disclosure further provides a method 1500 of driving a pixel unit as illustrated in a flow chart for method 1500 of FIG. 15. As examples, the pixel unit may include any one of pixel units illustrated in FIGS. 2, 3, and 8, which may include one or more of the pixel driving circuits illustrated in FIGS. 1, 9, and 10. The pixel unit includes a pixel driving circuit 101 and a light-emitting circuit, and the pixel driving circuit 101 includes a data write sub-circuit 10, an input and read sub-circuit 20, a drive sub-circuit 30, and an output control sub-circuit 40. The data write sub-circuit 10 is connected to the first node (A), the scan signal terminal (Gate) and the data voltage terminal (Data). The input and read sub-circuit 20 is connected to the second node (B), the first signal terminal S1 and the signal transmission terminal (P). The drive sub-circuit 30 is further connected to the first node (A) and the second node (B), and the output control sub-circuit 40 is connected to the drive sub-circuit 30, the light-emitting circuit, the enable signal terminal (EM), and the first voltage terminal V1. The light-emitting circuit is connected to the output control sub-circuit 40 of the pixel driving circuit 101 and the second voltage terminal V2. As shown in flow chart 1500, the method of driving the pixel unit includes:

In the first stage P1:

At 1512 of method 1500, the data write sub-circuit 10 transmits the first initialization signal of the data voltage terminal (Data) input to the first node (A) under control of the scan signal terminal (Gate).

At 1514 of method 1500, the input and read sub-circuit 20 transmits the second initialization signal input from the signal transmission terminal (P) to the second node (B) under control of the first signal terminal S1.

Figure 12:
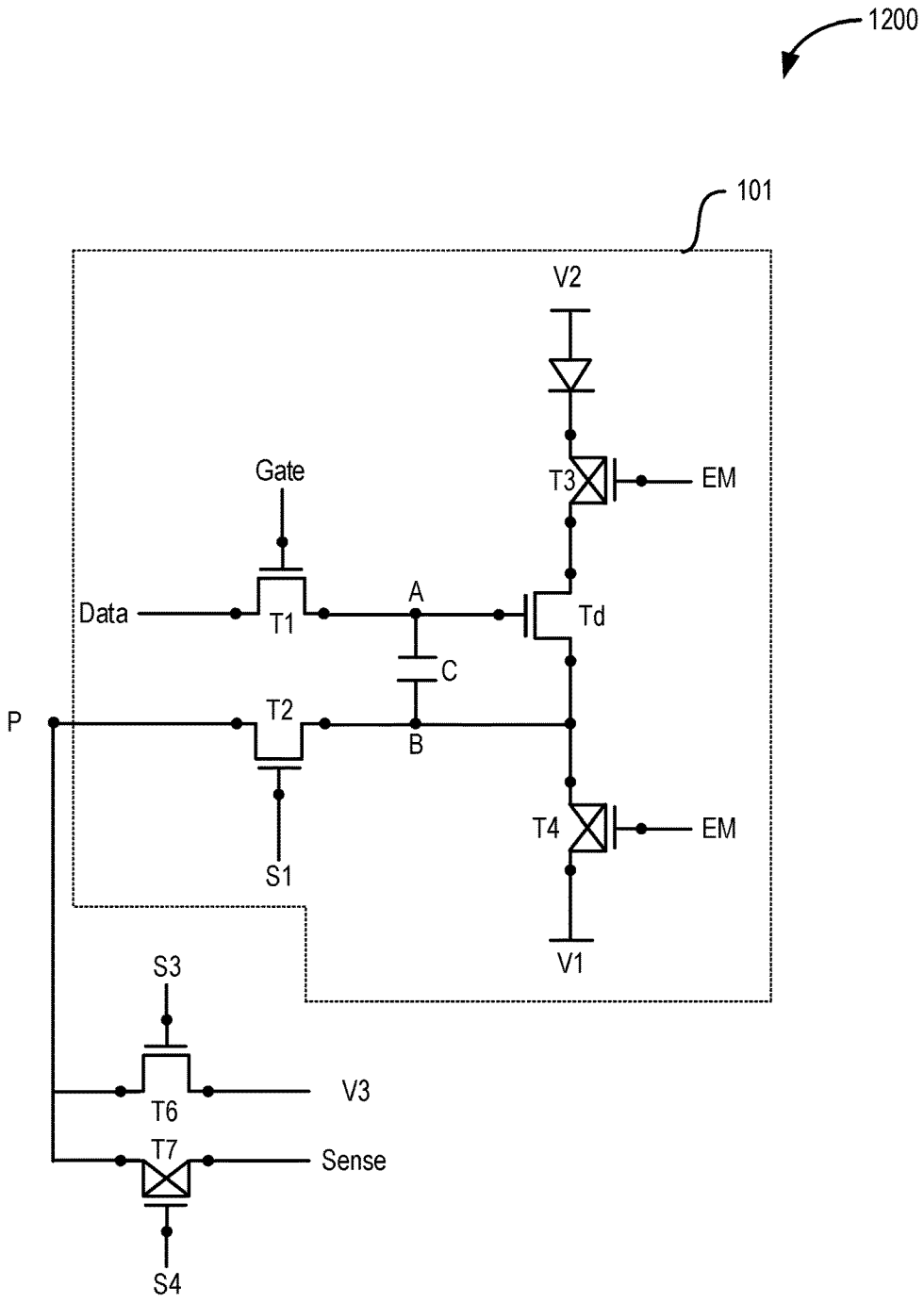
FIGS. 12 to 14 show circuit structural diagrams illustrating the driving process of each circuit in the array substrate shown in FIG. 10.

In some embodiments, as shown in circuit timing diagram 1100 of FIG. 11 and circuit structural diagram 1200 of FIG. 12, the first transistor T1 transmits the first initialization signal output by the data voltage terminal (Data) to the first node (A) under control of the scan signal terminal (Gate).

The second transistor T2 transmits the second initialization signal received by the signal transmission terminal (P) to the second node (B) under control of the first signal terminal S1.

For example, the sixth transistor T6 transmits the second initialization signal output by the third voltage terminal V3 to the signal transmission terminal (P) under control of the third signal terminal S3.

In the second stage P2:

At 1522 of method 1500, the data write sub-circuit 10 transmits the first data signal input by the data voltage terminal (Data) to the first node (A) under control of the scan signal terminal (Gate).

At 1524 of method 1500, the input and read sub-circuit 20 transmits the electrical signal of the second node (B) to the signal transmission terminal (P) under control of the first signal terminal S1.

Figure 13:
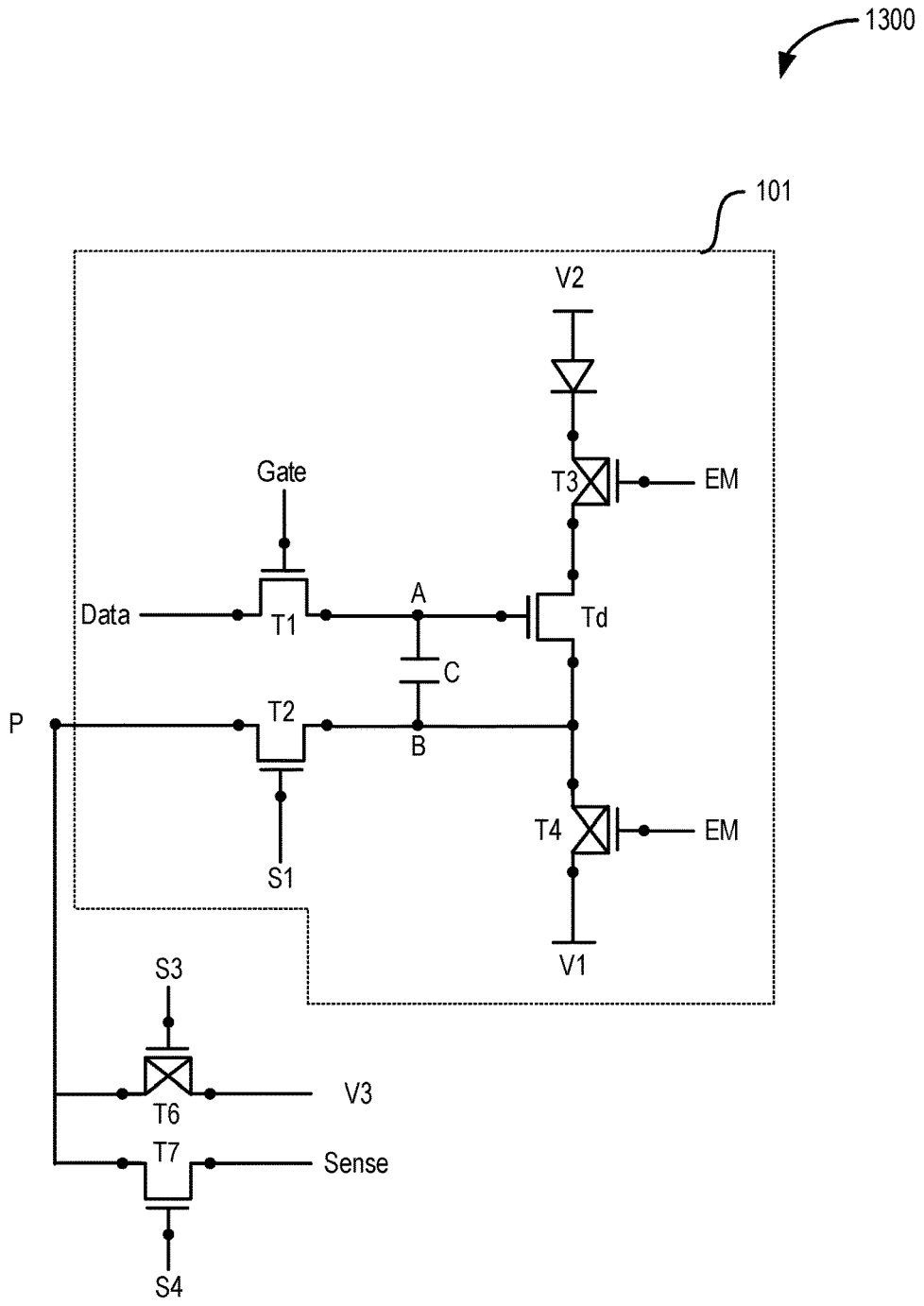

In some embodiments, as shown in circuit timing diagram 1100 of FIG. 11 and circuit structural diagram 1300 of FIG. 13, the first transistor T1 transmits the first data signal output by the data voltage terminal (Data) to the first node (A) under control of the scan signal terminal (Gate).

For example, the second transistor T2 transmits the electrical signal of the second node (B) to the signal transmission terminal (P) under control of the first signal terminal S1.

In the third stage P3:

At 1532 of method 1500, the data write sub-circuit 10 transmits the second data signal input by the data voltage terminal (Data) to the first node (A) under control of the scan signal terminal (Gate), and stores the second data signal to the drive sub-circuit 30, wherein the second data signal is a signal obtained by compensating the first data signal.

For example, the second signal can be obtained by the integrated circuit 110 receiving the electrical signal of the second node (B) output by the signal transmission terminal (P), and the second data signal is generated by comparing the electrical signal of the second node (B) with the electrical signal of the first node (A).

For example, the seventh transistor T7 transmits the electrical signal of the second node (B) received by the signal transmission terminal (P) to the read signal line (Sense) under control of the fourth signal terminal S4.

For example, the integrated circuit 110 receives the electrical signal of the second node (B) of the read signal line (Sense) output, and compares the electrical signal of the second node (B) with the electrical signal of the first node (A) to compensate the first data signal and to generate a second data signal.

At 1534 of method 1500, the input and read sub-circuit 20 transmits the potential signal input from the signal transmission terminal (P) to the second node (B) under control of the first signal terminal S1.

In some embodiments, as shown in circuit timing diagram 1100 of FIG. 11 and circuit structural diagram 1300 of FIG. 13, the first transistor T1 transmits the second data signal output by the data voltage terminal (Data) to the first node (A) under control of the scan signal terminal (Gate), and the second data signal is stored to the storage capacitor (C).

The second transistor T2 transmits the potential signal received by the signal transmission terminal (P) to the second node (B) under control of the first signal terminal S1.

For example, the sixth transistor T6 transmits the potential signal output from the third voltage terminal V3 to the signal transmission terminal (P) under control of the third signal terminal S3.

In the fourth stage P4:

At 1542 of method 1500, the output control sub-circuit 40 transmits the signal of the first voltage terminal V1 to the drive sub-circuit 30 under control of the enable signal terminal (EM), and at 1544 of method 1500, the drive sub-circuit 30 outputs a driving signal under control of a signal at the first node (A) and the signal of the first voltage terminal V1.

At 1546 of method 1500, the output control sub-circuit 40 transmits the driving signal to the light-emitting circuit under control of the enable signal terminal (EM).

At 1548 of method 1500, the light-emitting circuit emits light when driven by the driving signal and the signal of the second voltage terminal V2.

Figure 14:
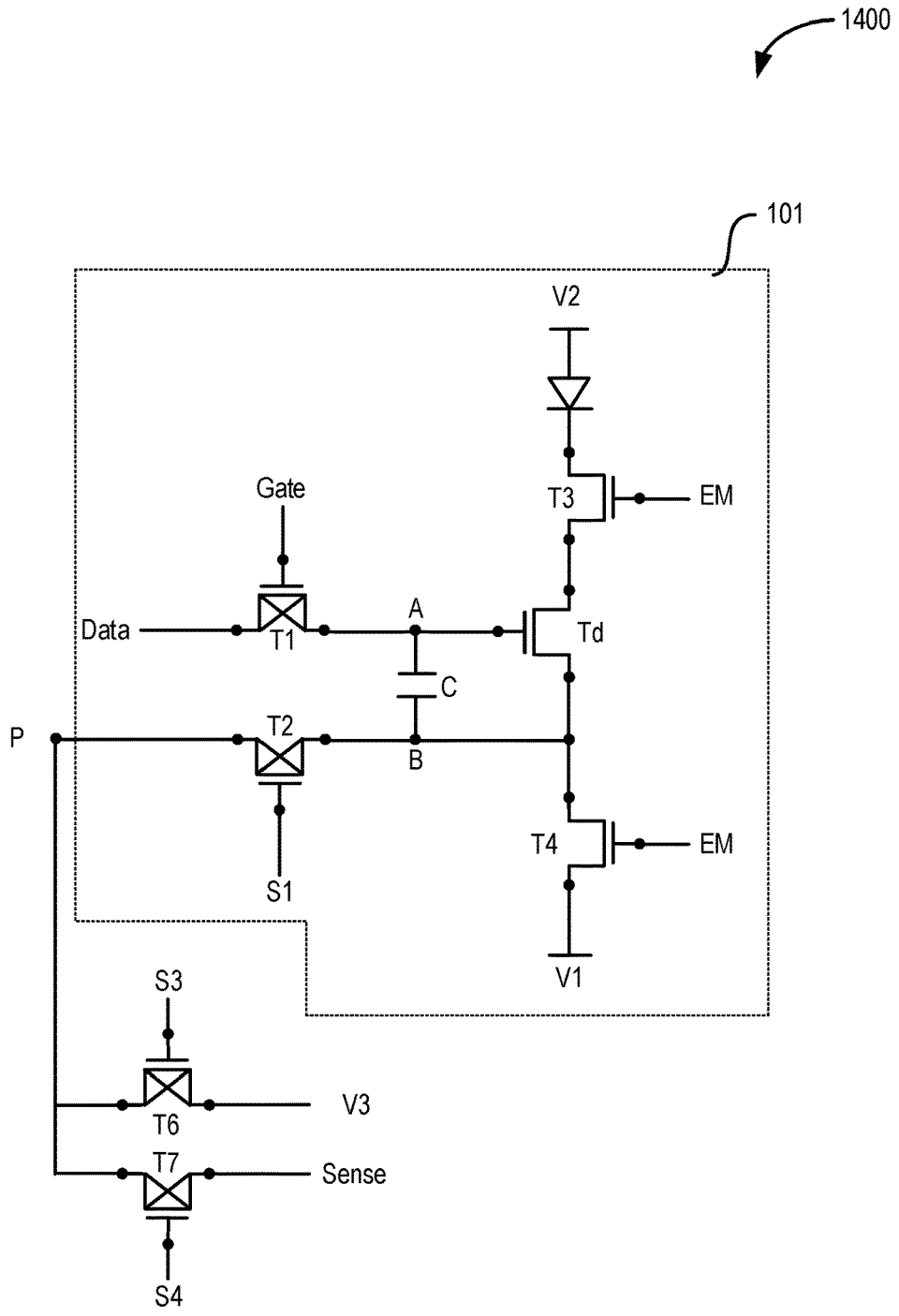

In some embodiments, as shown in circuit timing diagram 1100 and circuit structural diagram 1400 of FIGS. 11 and 14 respectively, the storage capacitor (C) transmits a second data signal stored therein to the gate of the drive transistor Td, and controls the drive transistor Td to be turned ON.

The fourth transistor T4 transmits the signal of the first voltage terminal V1 to the drive transistor Td under control of the enable signal terminal (EM), and the drive transistor Td outputs the driving signal under control of the second data signal and the signal of the first voltage terminal V1. The third transistor T3 transmits the driving signal to the light-emitting circuit under control of the enable signal terminal (EM).

The light-emitting circuit emits light when driven by the driving signal and the signal of the second voltage terminal V2.

The transmission circuit 60 can input a signal to the second node (B) of the pixel driving circuit 101 connected thereto, or read the electrical signal of the second node (B) of the pixel driving circuit 101 connected thereto, as may be determined by the switching of the second transistor T2 of the pixel driving circuit 101. The pixel driving circuits 101 in the same column are connected to the same data line, the second transistor T2 of the pixel driving circuits 101 is turned ON line by line (e.g., column by column), and the electrical signal of the second node (B) is transmitted to the integrated circuit 110 via the transmission circuit 60. The same row of pixel driving circuits 101 are respectively connected to different transmission circuits 60, and the plurality of transmission circuits 60 may be operated simultaneously.

Figure 16:
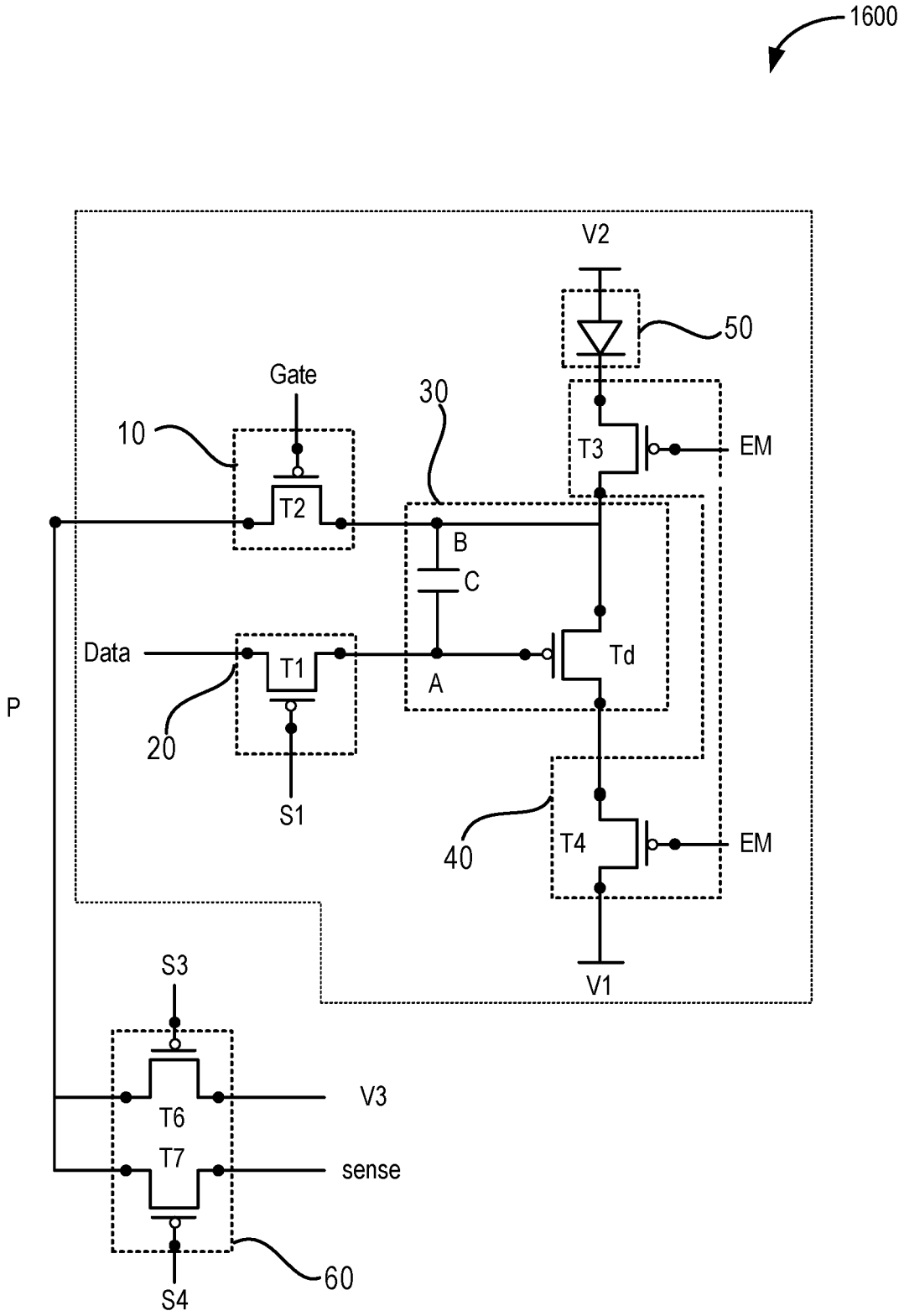
FIG. 16 shows a circuit diagram of an embodiment of a pixel driving circuit including one or more p-type transistor.

FIG. 16 illustrates a circuit diagram for a pixel driving circuit including one or more p-type transistors. One of ordinary skill in the art will be familiar with the differences in potentials of n-type and p-type transistors. During operation of the pixel driving circuit, high and low levels are interchanged relative to the opposite type circuit. However voltages at the other nodes remain unchanged. In embodiments including a p-type transistor, the threshold voltage Vth of Td in the node is negative.

In the method of driving the pixel unit provided by the embodiment of the present disclosure, the threshold voltage Vth of the drive transistor Td in the drive sub-circuit 30 is compensated in conjunction with an algorithm. In this way, the drive current generated by the pixel driving circuit drives the light-emitting circuit to emit light. Compared with the pixel unit voltage driving methods in the related art, the current driving mode provided by an embodiment of the present disclosure can effectively reduce the difference in the lighting voltage of the light-emitting circuit, thereby mitigating occurrence of the mura phenomenon at the display device.

The above is only a specific embodiment of the present disclosure, but the scope of the present disclosure is not limited thereto, and any person skilled in the art can easily think of changes or substitutions within the technical scope of the present disclosure. It should be covered by the scope of the present disclosure. Therefore, the scope of the invention should be determined by the scope of the appended claims.

It will be appreciated that the various embodiments of the present disclosure are described in a progressive manner, wherein each embodiment focuses on differences from other embodiments, and similar parts between the various embodiments may be referred to each other.

It will be appreciated that ordinal terms such as "first" and "second" are used merely to distinguish one entity or operation from another entity or operation, and do not necessarily require or imply any such actual relationship or order between these entities or operations.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

It is to be understood that the above embodiments are merely exemplary embodiments employed to explain the principles of the inventive concepts, but the inventive concepts are not limited thereto. Various modifications and improvements can be made by those skilled in the art without departing from the spirit and scope of the disclosure, and such modifications and improvements are also considered to be within the scope of the disclosure.

The invention claimed is:

1. A pixel driving circuit, comprising: a data write sub-circuit;

an input and read sub-circuit; a drive sub-circuit; and an output control sub-circuit, wherein the data write sub-circuit is connected to a first node, a scan signal terminal, and a data voltage terminal, and is configured to transmit, by the scan signal terminal, data signals input by the data voltage terminal at different times to the first node, a second node connected to a pole of the drive sub-circuit, the input and read sub-circuit is connected to the second node, a first signal terminal, and a signal transmission terminal, for transmitting a signal input by the signal transmission terminal to the second node under control of the first signal terminal, and reading an electrical signal of the second node to the signal transmission terminal, an integrated circuit receiving the electrical signal of the second node from the signal transmission terminal and outputting a compensated data signal to the data voltage terminal of the data write sub-circuit for transmission to the first node, the compensated data signal based on a comparison of an electrical signal of the first node and the electrical signal of the second node, the output control sub-circuit is respectively connected to the drive sub-circuit, a driven circuit; an enable signal terminal and a first voltage terminal, and is configured to transmit a signal of the first voltage terminal under control of the enable signal terminal to the drive sub-circuit, and to transmit a driving signal output by the drive sub-circuit to the driven circuit, and the drive sub-circuit comprising a drive transistor, the drive sub-circuit outputting the driving signal under control of a signal of the first node connected to a gate of the drive transistor and the signal of the first voltage terminal.

2. The pixel driving circuit according to claim 1, wherein the data write sub-circuit comprises a first transistor, wherein a gate of the first transistor is connected to the scan signal terminal, a first pole of the first transistor is connected to the data voltage terminal, and a second pole of the first transistor is connected to the first node.

3. The pixel driving circuit according to claim 1, wherein the input and read sub-circuit comprises a second transistor, wherein a gate of the second transistor is connected to the first signal terminal, a first pole of the second transistor is connected to the signal transmission terminal, and a second pole of the second transistor is connected to the second node.

4. The pixel driving circuit according to claim 1, wherein the drive sub-circuit comprises a storage capacitor, wherein a first terminal of the storage capacitor is connected to the first node, and a second terminal of the storage capacitor is connected to the second node, and a first pole of the drive transistor is connected to the output control sub-circuit, and a second pole of the drive transistor is connected to the second node and the output control sub-circuit.

5. The pixel driving circuit according to claim 1, wherein the output control sub-circuit comprises a third transistor and a fourth transistor, wherein a gate of the third transistor is connected to the enable signal terminal, a first pole of the third transistor is connected to the driven circuit, and a second pole of the third transistor is connected to the drive sub-circuit, a gate of the fourth transistor is connected to the enable signal terminal, a first pole of the fourth transistor is connected to the first voltage terminal, and a second pole of the fourth transistor is connected to the drive sub-circuit.

6. The pixel driving circuit according to claim 1, further comprising a transmission circuit; the transmission circuit is connected to the signal transmission terminal, and the transmission circuit is configured to input a signal to the signal transmission terminal and to read the electrical signal of the second node output by the signal transmission terminal.

7. The pixel driving circuit according to claim 6, wherein the transmission circuit includes a fifth transistor, a gate of the fifth transistor is connected to the second signal terminal, a first pole of the fifth transistor is connected to the signal transmission terminal, and a second pole of the fifth transistor is connected to a read signal line, wherein the read signal line is configured for transmitting a signal input to the signal transmission terminal, or for transmitting the electrical signal of the second node output by the signal transmission terminal; or, the transmission circuits includes a sixth transistor and a seventh transistor, a gate of the sixth transistor is connected to a third signal terminal, a first pole of the sixth transistor is connected to the signal transmission terminal, and a second pole of the sixth transistor is connected to a third voltage terminal, a gate of the seventh transistor is connected to a fourth signal terminal, a first pole of the seventh transistor is connected to the signal transmission terminal, and a second pole of the seventh transistor is connected to the read signal line.

8. A pixel unit, comprising a light-emitting circuit and the pixel driving circuit according to claim 1, wherein the light-emitting circuit is connected to the output control sub-circuit of the pixel driving circuit and a second voltage terminal for emitting light when driven by the driving signal output by the pixel driving circuit and the signal of the second voltage terminal.

9. The pixel unit according to claim 8, wherein the light-emitting circuit comprises a self-luminous device, wherein an anode of the self-luminous device is connected to the second voltage terminal, a cathode of the self-luminous device is connected to a first pole of a third transistor of the output control sub-circuit, and a signal output by the second voltage terminal is higher than a signal output by the first voltage terminal of the pixel driving circuit, or, an anode of the self-luminous device is connected to a first pole of a third transistor of the output control sub-circuit, a cathode of the self-luminous device is connected to the second voltage terminal, and the signal output by the second voltage terminal is lower than the signal output by the first voltage terminal of the pixel driving circuit.

10. An array substrate comprising a plurality of pixel driving circuits the pixel driving circuit comprising:

a data write sub-circuit; an input and read sub-circuit; a drive sub-circuit; and an output control sub-circuit, wherein the data write sub-circuit is connected to a first node, a scan signal terminal, and a data voltage terminal, and is configured to transmit, by the scan signal terminal, a data signal input by the data voltage terminal at different times to the first node, the input and read sub-circuit is connected to a second node, a first signal terminal, and a signal transmission terminal, for transmitting a signal input by the signal transmission terminal to the second node under control of the first signal terminal, and reading an electrical signal of the second node to the signal transmission terminal, the output control sub-circuit is respectively connected to the drive sub-circuit, a driven circuit, an enable signal terminal and a first voltage terminal, and is configured to transmit a signal of the first voltage terminal under control of the enable signal terminal to the drive sub-circuit, and to transmit a driving signal output by the drive sub-circuit to the driven circuit, and the drive sub-circuit is further connected to the first node and the second node for outputting the driving signal under control of a signal of the first node and the signal of the first voltage terminal, and an integrated circuit receiving the electrical signal of the second node and generating a compensated data signal based on a comparison of the electrical signal of the second node with an electrical signal of the first node, and the compensated data signal transmitted by the data voltage terminal to the data write sub-circuit.

11. The array substrate according to claim 10, wherein the array substrate further comprises a plurality of transmission circuits, the plurality of pixel driving circuits are grouped into a plurality of groups of pixel driving circuits, each of the plurality of groups of pixel driving circuits comprises multiple pixel driving circuits, a plurality of light-emitting circuits, each of the multiple pixel driving circuits connected to one of the plurality of light-emitting circuits, each of the plurality of light-emitting circuits is connected to the output control sub-circuit of one of the multiple pixel driving circuits and a second voltage terminal for emitting light when driven by the driving signal output by the one of the multiple pixel driving circuits and the signal of the second voltage terminal, wherein each of the plurality of groups of pixel driving circuits is connected to one of the plurality of transmission circuits, each of the plurality of transmission circuits is connected to the signal transmission terminal of each of the multiple pixel driving circuits, and each of the plurality of transmission circuits is configured to input a signal to the signal transmission terminal and to read the electrical signal of the second node output by the signal transmission terminal.

12. The array substrate according to claim 11, further comprising a display area and a non-display area, wherein the plurality of transmission circuits are positioned in the non-display area, and the plurality of pixel driving circuits and the plurality of light-emitting circuits are positioned in the display area.

13. The array substrate according to claim 11, wherein the transmission circuit includes a fifth transistor, a gate of the fifth transistor is connected to the second signal terminal, a first pole of the fifth transistor is connected to the signal transmission terminal, and a second pole of the fifth transistor is connected to a read signal line, wherein the read signal line is configured for transmitting a signal input to the signal transmission terminal, or for transmitting the electrical signal of the second node output by the signal transmission terminal;

or, the transmission circuit includes a sixth transistor and a seventh transistor, a gate of the sixth transistor is connected to a third signal terminal, a first pole of the sixth transistor is connected to the signal transmission terminal, and a second pole of the sixth transistor is connected to a third voltage terminal, a gate of the seventh transistor is connected to a fourth signal terminal, a first pole of the seventh transistor is connected to the signal transmission terminal, and a second pole of the seventh transistor is connected to the read signal line.

14. A display device, comprising the array substrate according to claim 10, further comprising an integrated circuit connected to the signal transmission terminal, wherein the integrated circuit is configured to receive the electrical signal of the second node output by the signal transmission terminal to obtain a threshold voltage of the drive sub-circuit, and generate a compensated data signal.

15. The display device according to claim 14, wherein the array substrate comprises a transmission circuit, a first end of the transmission circuit connected to the signal transmission terminal, a second end of the transmission circuit connected to the read signal line, the integrated circuit is connected to the read signal line, and the electrical signal of the second node output by the signal transmission terminal is transmitted to the integrated circuit by way of the read signal line.

16. A method of driving a pixel unit, the pixel unit including a pixel driving circuit and a light-emitting circuit, and the pixel driving circuit including a data write sub-circuit, an input and read sub-circuit, a drive sub-circuit, and an output control sub-circuit, the method comprising, during a first stage, transmitting a first initialization signal input by a data voltage terminal from the data write sub-circuit to a first node under control of the scan signal terminal, and transmitting a second initialization signal input by the signal transmission terminal from the input and read sub-circuit to a second node under control of the first signal terminal, during a second stage, transmitting a first data signal input by the data voltage terminal from the data write sub-circuit to the first node under control of the scan signal terminal, and the input and read sub-circuit transmitting an electrical signal of the second node to the signal transmission terminal under control of the first signal terminal, during a third stage, transmitting a second data signal input by the data voltage terminal from the data write sub-circuit to the first node under control of the scan signal terminal, and storing the second data signal to a drive sub-circuit, wherein the second data signal includes a signal obtained by compensating the first data signal, and transmitting a potential signal received by the signal transmission terminal to the second node under control of the first signal terminal, and during a fourth stage, transmitting a signal of the first voltage terminal from the output control sub-circuit to the drive sub-circuit under control of an enable signal terminal, the drive sub-circuit outputting a driving signal under control of a signal of the first node and the signal of the first voltage terminal, transmitting the driving signal from the output control sub-circuit to the light-emitting circuit under control of the enable signal terminal, and emitting light from the light-emitting circuit when driven by the driving signal and a signal of a second voltage terminal.

17. The method of driving the pixel unit according to claim 16, wherein, during the first stage, transmitting the first initialization signal from the data write sub-circuit to the first node under control of the scan signal terminal includes transmitting the first initialization signal from a first transistor of the data write sub-circuit to the first node under control of the scan signal terminal, and transmitting the second initialization signal to the second node under control of the first signal terminal includes transmitting the second initialization signal from a second transistor of the input and read sub-circuit to the second node under control of the scan signal terminal, during the second stage, transmitting the first data signal to the first node under control of the scan signal terminal includes transmitting the first data signal from the first transistor to the first node under control of the scan signal terminal, and transmitting the electrical signal of the second node to the signal transmission terminal under control of the first signal terminal includes transmitting the electrical signal of the second node from the second transistor to the signal transmission terminal under control of the first signal terminal, during the third stage, transmitting the second data signal to the first node under control of the scan signal terminal includes transmitting the second data signal from the first transistor to the first node under control of the scan signal terminal, storing the second data signal to the drive sub-circuit includes storing the second data signal to a storage capacitor of the drive sub-circuit, and transmitting the potential signal input by the signal transmission terminal to the second node under control of the first signal terminal includes transmitting the potential signal input by the signal transmission terminal from the second transistor to the second node under control of the first signal terminal, and during the fourth stage, transmitting the second data signal stored in the storage capacitor to a gate of a drive transistor of the drive sub-circuit to control activation of the drive transistor, transmitting the signal of the first voltage terminal to the drive transistor under control of the enable signal terminal includes transmitting the signal of the first voltage terminal from a fourth transistor of the output control sub-circuit, outputting the driving signal from the drive sub-circuit under control of the signal of the first node and the signal of the first voltage terminal includes outputting the driving signal from the drive transistor under control of the second data signal and the signal of the first voltage terminal, transmitting the driving signal to a light-emitting circuit under control of the enable signal terminal includes transmitting the driving signal from a third transistor of the output control sub-circuit to a light-emitting circuit under control of the enable signal terminal.

18. The method according to claim 17, wherein the data write sub-circuit is connected to the first node, the scan signal terminal and the data voltage terminal, the input and read sub-circuit is connected to the second node, the first signal terminal and the signal transmission terminal, the drive sub-circuit is connected to the first node and the second node, the output control sub-circuit is respectively connected to the drive sub-circuit, the light-emitting circuit, the enable signal terminal and the first voltage terminal, and the light-emitting circuit is connected to the output control sub-circuit of the pixel driving circuit and the second voltage terminal.

19. The method of driving the pixel unit according to claim 16, further comprising driving a transmission circuit, wherein the pixel driving circuit transmits the electrical signal of the second node output by the signal transmission terminal by way of a read signal line, wherein the read signal line is configured for transmitting a signal input to the signal transmission terminal, or for transmitting the electrical signal of the second node output by the signal transmission terminal.

20. The method according to claim 19, wherein the data write sub-circuit comprises the first transistor, the input and read sub-circuit comprises the second transistor, the drive sub-circuit comprises the drive transistor and the storage capacitor, and the output control sub-circuit comprises the third transistor and the fourth transistor.

* * * * *